US005848445A

United States Patent [19]

Cranz

[11] Patent Number: 5,848,445

[45] Date of Patent: Dec. 15, 1998

[54] BATHTUB WITH HEAD AND NECK SUPPORT

[76] Inventor: Hunter Cranz, P.O. Box 352, Valdez, Ak. 99686

[21] Appl. No.: 756,215

[22] Filed: Nov. 23, 1996

[51] Int. Cl.[6] ..... A47K 3/022

[52] U.S. Cl. ..... 4/589; 4/575.1

[58] Field of Search ..... 4/589, 590, 541.1, 4/519, 530, 573.1, 575.1; D23/277, 278, 280.1, 289

[56] References Cited

U.S. PATENT DOCUMENTS

| | | | |
|---|---|---|---|
| D. 103,216 | 2/1937 | Cevasco | D23/278 |
| D. 284,890 | 7/1986 | Delephine | D23/277 |
| 1,546,536 | 7/1925 | Black | 4/590 |
| 1,962,076 | 6/1934 | Jadkowski | 4/590 |
| 4,651,361 | 3/1987 | Nolan | 4/519 |
| 4,766,620 | 8/1988 | Boyhan | 4/519 |
| 4,954,179 | 9/1990 | Franninge | 4/541.1 |

FOREIGN PATENT DOCUMENTS

| | | | |
|---|---|---|---|
| 2015139 | 10/1971 | Germany | 4/589 |
| 3042037 | 5/1982 | Germany | 4/589 |
| 6-141997 | 5/1994 | Japan | 4/589 |
| 88/00037 | 1/1988 | WIPO | 4/589 |

*Primary Examiner*—Charles R. Eloshway
*Attorney, Agent, or Firm*—Michael J. Tavella

[57] ABSTRACT

A bathtub that has a contoured head support and a contoured neck support formed in the lower portions of the tub. The tub comes in a standard length (in which the knees are drawn up) and a full length size (84 inches long) in which the user lies flat. In both cases, the head is not only supported above the water so drowning is prevented, the head and neck are supported at the proper angle so that all four spinal curves are in proper alignment.

17 Claims, 12 Drawing Sheets

BATHTUB WITH HEAD AND NECK SUPPORT

This invention relates to bath tubs for reclining in and particularly to bath tubs for reclining in having integral head and neck supports.

BACKGROUND OF THE INVENTION

Bath tubs have evolved over the years from simple wash tubs to elaborate and ornate fixtures. Some tubs include bubble action and other amenities. Despite these improvements, bath tubs still have one main problem: they are not designed to allow a user to lie flat in the tub. The biggest reason for this is to prevent people from drowning. Although prevention of drowning is an important consideration in bath tub design, this restriction causes other problems. Most bath tubs today force the bather into a semi reclined position with the head pressed forward and down over the chest. This is uncomfortable and harmful to the body. Pushing the head forward flattens the cervical curve of the neck. It also similarly distorts the thoracic and lumbar curves and stresses the sacrum.

One alternative is simply to sit up in the tub. However, sitting upright is stressful to the lower back. The best position for resting in a tub is to lie with the torso flat in the tub and the knees bent, or better yet, with the legs fully extended. This position offers the best comfort for the head, neck and spine.

Simply supporting the neck is not the answer unless full support for the head can be accommodated because it can intensify rather than flatten the four natural curves of the spine, which is just as detrimental as flattening them.

Several bath tubs with some type of neck support have been developed. All of these suffer from the problems discussed above in that they do not support the head and back properly, thereby being uncomfortable at best or harmful at worst. Examples of these designs can be found in U. S. Patents as follows: U.S. Pat. No. 3,295,146 teaches a support device for a user. It fits over the side walls of a tub and lays in the plane of the top of the tub. This places the head at a high location within the tub. Although it is safe, it bends the back and neck in an uncomfortable position. U.S. Pat. No. 1,315,643 shows a tub having a contoured wall surface that can act as a head support as well as a seat. Again, the problem here is that the head is supported at a very bad angle, causing stress in the back and neck. U.S. Pat. No. 1,962,076 shows another contour tub. This tub has additional contours for the back and seat. However, these contours are at a bad angle for the back and neck. It does no good to provide support for the neck and back if the support puts the neck and back into an uncomfortable position. Pat. No. 1,546,536 shows another type of tub that has a high neck support. Clearly this type of neck support is not conducive to relaxation. U. S. Pat. No. 2,828,489 and UK patent 2,053,673, show tubs for infants that have head supports. However, these tubs, like those above, the head support is designed to prevent drowning and is not at all conducive to relaxing and eliminating stress points on the head and spine while in a tub. Finally, U.S. Pat. No. 4,734,944 illustrates a popular style of spa that is now available. These spas are large tubs designed for outdoor use. Although they allow reclining, the tubs have seats that provide an angled surface that does not permit a user to fully recline. Again, these spas use large quantities of water and the danger of drowning is high unless the user's head remains out of the water.

SUMMARY OF THE INVENTION

The instant invention overcomes these problems. It is a bathtub that has contoured head and neck supports formed directly into the tub. The tub comes in a standard length (60 inches long), in which the knees are drawn up, and a full length size (84 inches long) in which the user lies flat. In both cases, the head is not only supported above the water so drowning is prevented, the head and neck are supported at the proper angle so that all for spinal curves are in proper alignment. To say that lying in this tub is like being in heaven, is an understatement.

DETAILED DESCRIPTION OF THE INVENTION

Figure 1:
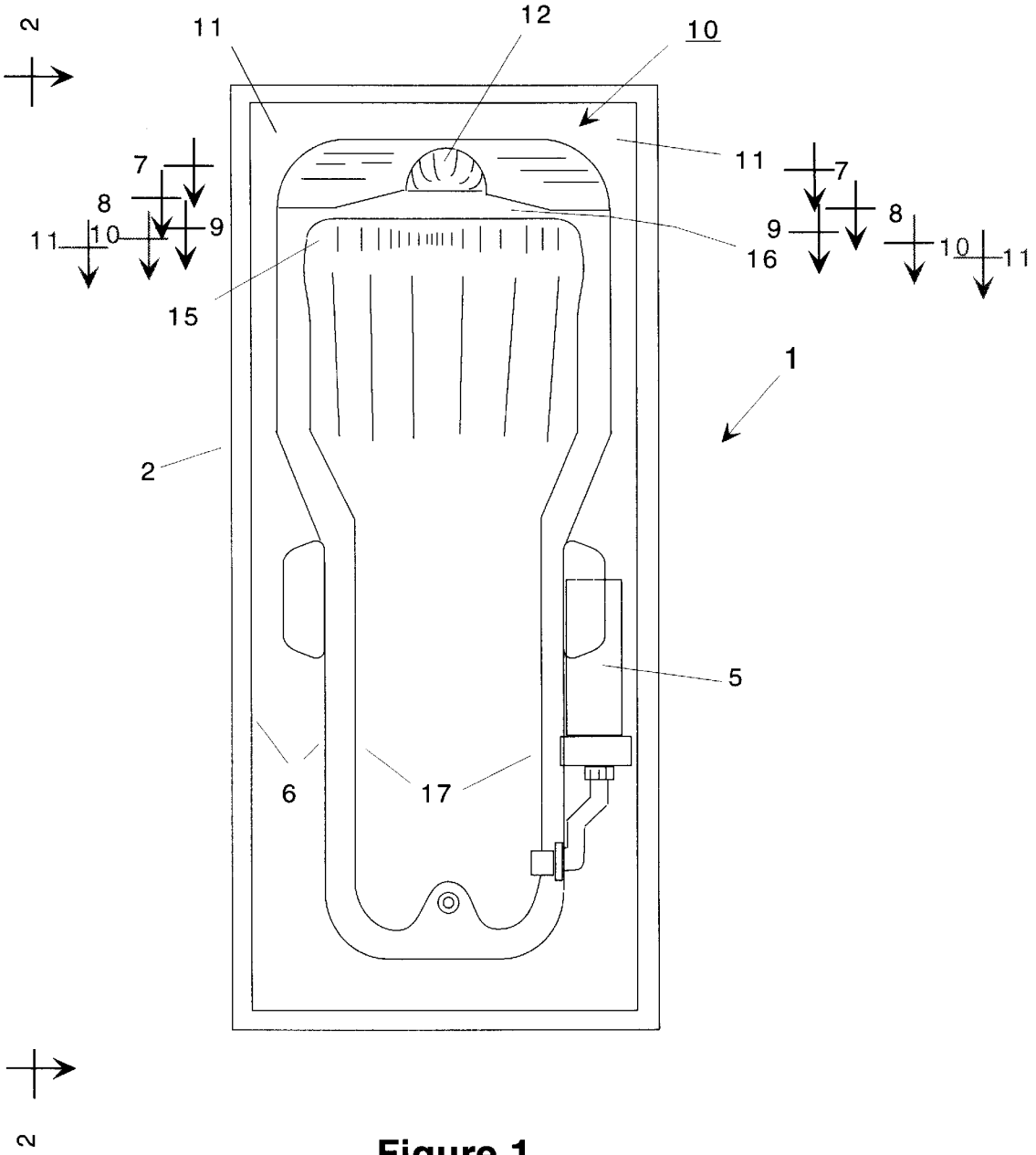
FIG. 1 is a top view of my new full-length tub.
Figure 2:
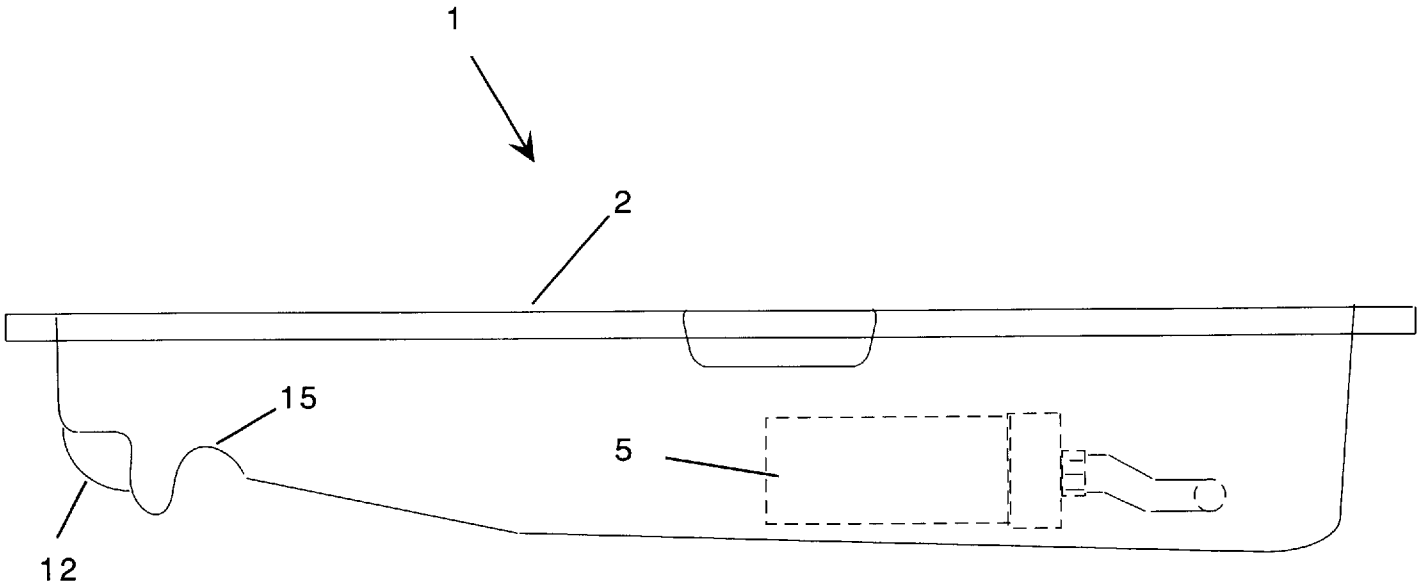
FIG. 2 is a cross-sectional view of my new tub taken along the lines 2—2 of FIG. 1.
Figure 12:
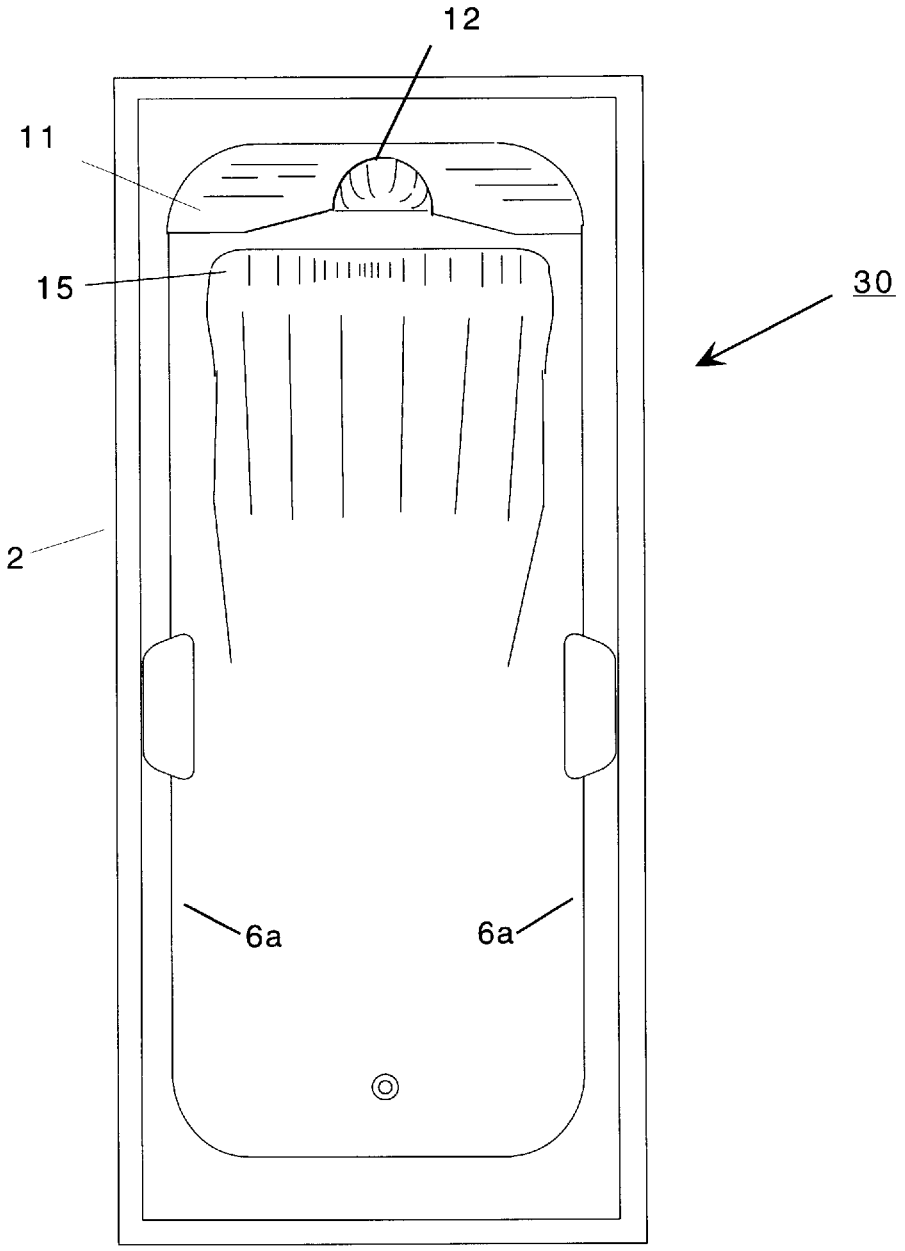
FIG. 12 is a top view of my new tub without jetting equipment.

Referring now to FIG. 1, the preferred embodiment of my new tub 1 is shown. The tub 1 has a rectangular perimeter 2 that forms a slight deck as shown. This deck 2 can be from four to six inches wide. The preferred embodiment has for a four inch deck 2 formed around the tub perimeter. The tub 1 is designed to be placed in a support frame that forms a tub enclosure 3 (see FIG. 3). FIG. 1 shows the tub 1 with jetting equipment 5 (see also FIG. 2). To fit the jetting equipment into the tub enclosure 3, the side distance between walls 6 of the tub 1 must be narrowed as shown by numeral 17. FIG. 12 shows a tub 30 without jetting. In this design, the side walls 6*a* are straight because they do not have to accommodate the jetting equipment 5. All other features of this tub 30 are the same as the other tubs.

Figure 13:
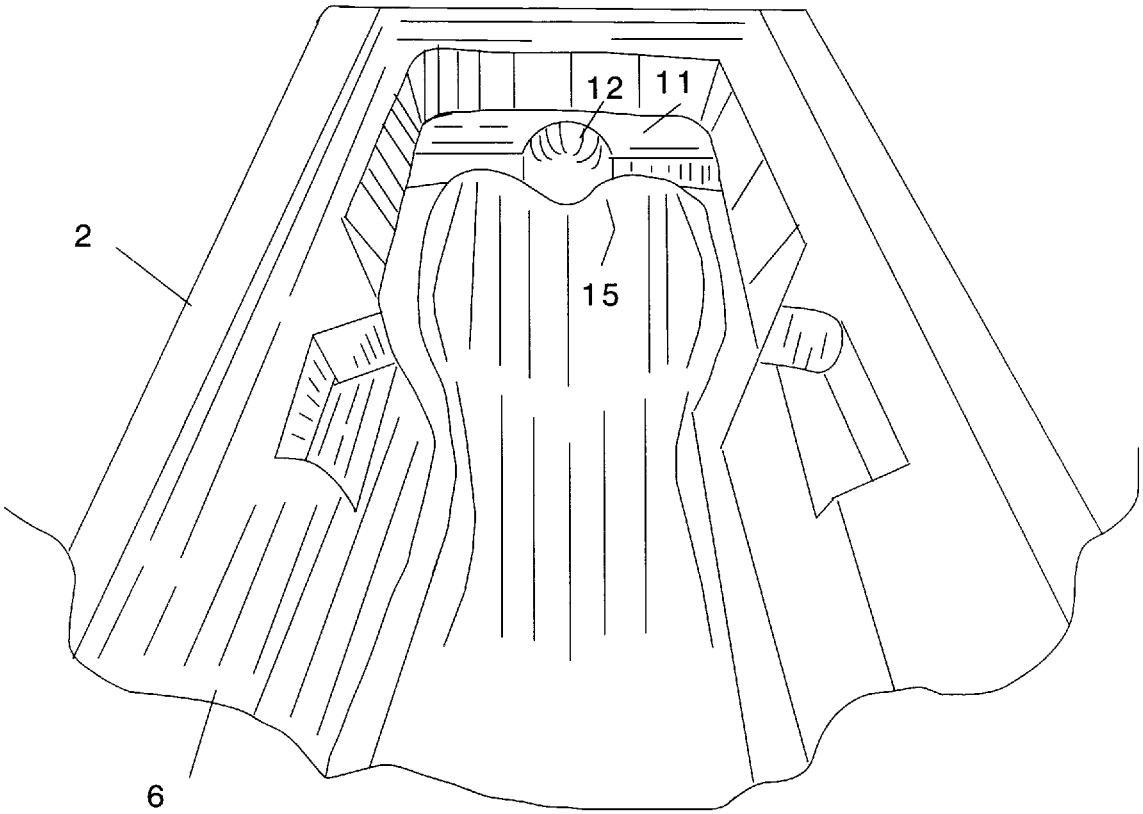
FIG. 13 is a perspective view of my new tub showing the head bowl and neck support.
Figure 14:
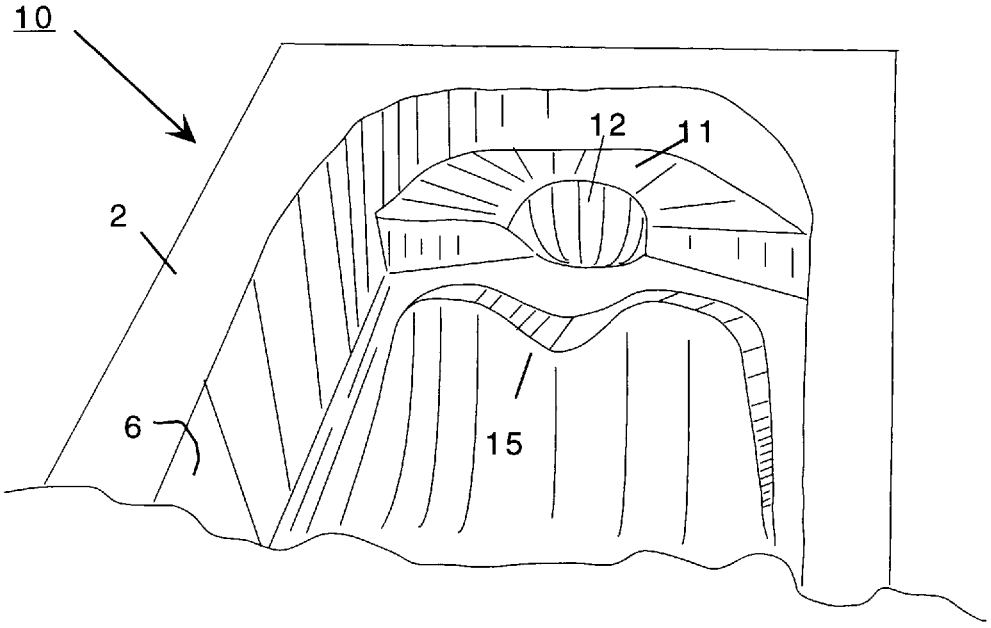
FIG. 14 is a detail perspective view of my new tub showing the head bowl and neck support.

A unique feature of this tub 1 is the head and neck support system. FIGS. 13 and 14 show the shapes of the head support 10 and neck support 15 in perspective. The head support 10 is formed from a raised shelf 11, located at the head of the tub 1. In the center of this shelf 11 is a semi-spherical head bowl 12 that is cut into the shelf 11 as shown. The head bowl 12 is designed to hold average sized heads without restraint. At a spaced distance from the shelf 11 is a neck support 15. The neck support 15 is a sculpted portion that has a sloped pair of ridges that form a recessed portion between them. A space 16 is provided between the shelf 11 and the neck support 15 to allow water to drain from the head bowl 12 and shelf 11. The space 16 extends to the side walls 6 of the tub 1. The neck support 15 ridges do not extend to the side walls 6, the space between the ridges and the side walls 6 connects to the space 16, which forms a channel to allow all the water in the head of the tub 1 to drain completely.

Referring now to FIGS. 7–11 and 13 and 14, details of the neck support 15 are shown. A complete data sheet, showing the height measurements at half-inch intervals along the length of the tub 30 and one-inch intervals across the width of the tub 30, is attached as an appendix. The height measurements shown in the table are the exact measurement of the tub floor height at any pair of coordinates chosen. The top horizontal axis of the data table shows the width measurements for a 30 inch wide tub. The zero point is the center of the tub 30. The length is for a tub having an interior length of 84 inches. This data table is for a tub 30 with no jetting 5 and straight side walls 6*a*, such as the tub 30 shown in FIG. 12. The data points indicate the height of the tub surface from flat bottom to the top of the bottom surface of the tub. For example, at point (0,0), where the first number indicates the length (y) coordinate and the second number indicates the width (x) coordinate, the reading is 16 inches. This represents the deck portion of the tub 30, which is at full height of the tub wall. At point (22,0) the reading is 2.75 inches. This is read that at a point 22 inches from the head of the tub 30, at the centerline of the tub, the tub floor is 2.75 inches high. Thus, the tub floor height at all the points indicated is provided.

TABLE 1

Top line of each page shows position from center line of tub in inches
Left Column shows distance from head of tub (0.0) to foot of tub (88.0) in inches
Data in table shows height of tub floor at indicated points in inches

| | −18.0 | −17.0 | −16.0 | −15.0 | −14.0 | −13.0 | −12.0 | −11.0 | −10.0 |
|---|---|---|---|---|---|---|---|---|---|
| 0.0 | 16.000 | 16.000 | 16.000 | 16.000 | 16.000 | 16.000 | 16.000 | 16.000 | 16.000 |
| 0.5 | 16.000 | 16.000 | 16.000 | 16.000 | 16.000 | 16.000 | 16.000 | 16.000 | 16.000 |
| 1.0 | 16.000 | 16.000 | 16.000 | 16.000 | 16.000 | 16.000 | 16.000 | 16.000 | 16.000 |
| 1.5 | 16.000 | 16.000 | 16.000 | 16.000 | 16.000 | 16.000 | 16.000 | 16.000 | 16.000 |
| 2.0 | 16.000 | 16.000 | 16.000 | 16.000 | 16.000 | 16.000 | 16.000 | 16.000 | 16.000 |
| 2.5 | 16.000 | 16.000 | 16.000 | 16.000 | 16.000 | 16.000 | 16.000 | 16.000 | 16.000 |
| 3.0 | 16.000 | 16.000 | 16.000 | 16.000 | 16.000 | 16.000 | 16.000 | 16.000 | 16.000 |
| 3.5 | 16.000 | 16.000 | 16.000 | 16.000 | 8.000 | 8.000 | 8.000 | 8.000 | 8.000 |
| 4.0 | 16.000 | 16.000 | 16.000 | 16.000 | 7.875 | 7.875 | 7.875 | 7.875 | 7.875 |
| 4.5 | 16.000 | 16.000 | 16.000 | 16.000 | 7.813 | 7.813 | 7.813 | 7.813 | 7.813 |
| 5.0 | 16.000 | 16.000 | 16.000 | 16.000 | 7.813 | 7.813 | 7.813 | 7.813 | 7.813 |
| 5.5 | 16.000 | 16.000 | 16.000 | 16.000 | 7.813 | 7.813 | 7.813 | 7.813 | 7.813 |
| 6.0 | 16.000 | 16.000 | 16.000 | 16.000 | 7.813 | 7.813 | 7.813 | 7.813 | 7.813 |
| 6.5 | 16.000 | 16.000 | 16.000 | 16.000 | 7.813 | 7.813 | 7.813 | 7.813 | 7.813 |
| 7.0 | 16.000 | 16.000 | 16.000 | 16.000 | 7.813 | 7.813 | 7.813 | 7.813 | 7.813 |
| 7.5 | 16.000 | 16.000 | 16.000 | 16.000 | 7.813 | 7.813 | 7.813 | 7.813 | 7.813 |
| 8.0 | 16.000 | 16.000 | 16.000 | 16.000 | 7.813 | 7.813 | 7.813 | 7.813 | 7.813 |
| 8.5 | 16.000 | 16.000 | 16.000 | 16.000 | 7.813 | 7.813 | 7.813 | 7.813 | 7.813 |
| 9.0 | 16.000 | 16.000 | 16.000 | 16.000 | 7.813 | 7.813 | 7.813 | 7.813 | 7.813 |
| 9.5 | 16.000 | 16.000 | 16.000 | 16.000 | 7.813 | 7.813 | 7.813 | 7.813 | 7.875 |
| 10.0 | 16.000 | 16.000 | 16.000 | 16.000 | 7.813 | 7.719 | 7.563 | 7.438 | 7.250 |
| 10.5 | 16.000 | 16.000 | 16.000 | 16.000 | 6.875 | 6.563 | 6.500 | 6.375 | 6.125 |
| 11.0 | 16.000 | 16.000 | 16.000 | 16.000 | 5.625 | 5.500 | 5.438 | 5.250 | 5.000 |
| 11.5 | 1G.000 | 16.000 | 16.000 | 16.000 | 4.719 | 4.438 | 4.344 | 4.313 | 4.313 |
| 12.0 | 16.000 | 16.000 | 16.000 | 16.000 | 4.219 | 4.156 | 4.188 | 4.125 | 4.188 |
| 12.5 | 16.000 | 16.000 | 16.000 | 16.000 | 4.094 | 4.063 | 4.125 | 4.188 | 4.375 |
| 13.0 | 16.000 | 16.000 | 16.000 | 16.000 | 4.001 | 4.031 | 4.063 | 4.188 | 5.313 |
| 13.5 | 16.000 | 16.000 | 16.000 | 16.000 | 3.948 | 4.031 | 4.063 | 4.188 | 6.250 |
| 14.0 | 16.000 | 16.000 | 16.000 | 16.000 | 3.894 | 3.975 | 4.125 | 4.188 | 6.813 |
| 14.5 | 16.000 | 16.000 | 16.000 | 16.000 | 3.841 | 3.920 | 4.313 | 5.813 | 6.875 |
| 15.0 | 16.000 | 16.000 | 16.000 | 16.000 | 3.787 | 3.864 | 4.500 | 5.750 | 6.781 |
| 15.5 | 16.000 | 16.000 | 16.000 | 16.000 | 3.734 | 3.808 | 4.594 | 5.500 | 6.344 |
| 16.0 | 16.000 | 16.000 | 16.000 | 16.000 | 3.680 | 3.752 | 4.625 | 5.344 | 6.044 |
| 16.5 | 16.000 | 16.000 | 16.000 | 16.000 | 3.627 | 3.696 | 4.531 | 5.125 | 5.696 |
| 17.0 | 16.000 | 16.000 | 16.000 | 16.000 | 3.573 | 3.640 | 4.438 | 4.893 | 5.348 |
| 17.5 | 16.000 | 16.000 | 16.000 | 16.000 | 3.520 | 3.584 | 4.375 | 4.688 | 5.000 |
| 18.0 | 16.000 | 16.000 | 16.000 | 16.000 | 3.466 | 3.528 | 4.290 | 4.520 | 4.750 |
| 18.5 | 16.000 | 16.000 | 16.000 | 16.000 | 3.413 | 3.473 | 4.188 | 4.344 | 4.500 |
| 19.0 | 16.000 | 16.000 | 16.000 | 16.000 | 3.359 | 3.417 | 4.063 | 4.250 | 4.313 |
| 19.5 | 16.000 | 16.000 | 16.000 | 16.000 | 3.306 | 3.361 | 4.000 | 4.063 | 4.125 |
| 20.0 | 16.000 | 16.000 | 16.000 | 16.000 | 3.252 | 3.305 | 3.875 | 3.938 | 3.875 |
| 20.5 | 16.000 | 16.000 | 16.000 | 16.000 | 3.199 | 3.249 | 3.750 | 3.688 | 3.719 |
| 21.0 | 16.000 | 16.000 | 16.000 | 16.000 | 3.145 | 3.193 | 3.625 | 3.625 | 3.500 |
| 21.5 | 16.000 | 16.000 | 16.000 | 16.000 | 3.092 | 3.137 | 3.500 | 3.500 | 3.250 |
| 22.0 | 16.000 | 16.000 | 16.000 | 16.000 | 3.038 | 3.081 | 3.375 | 3.313 | 3.188 |
| 22.5 | 16.000 | 16.000 | 16.000 | 16.000 | 2.985 | 3.026 | 3.313 | 3.188 | 3.125 |
| 23.0 | 16.000 | 16.000 | 16.000 | 16.000 | 2.931 | 2.970 | 3.219 | 3.063 | 3.000 |
| 23.5 | 16.000 | 16.000 | 16.000 | 16.000 | 2.878 | 2.914 | 3.125 | 3.000 | 2.931 |
| 24.0 | 16.000 | 16.000 | 16.000 | 16.000 | 2.824 | 2.858 | 2.969 | 2.875 | 2.863 |

TABLE 1-continued

Top line of each page shows position from center line of tub in inches
Left Column shows distance from head of tub (0.0) to foot of tub (88.0) in inches
Data in table shows height of tub floor at indicated points in inches

| | | | | | | | | | |
|---|---|---|---|---|---|---|---|---|---|
| 24.5 | 16.000 | 16.000 | 16.000 | 16.000 | 2.771 | 2.802 | 2.938 | 2.880 | 2.794 |
| 25.0 | 16.000 | 16.000 | 16.000 | 16.000 | 2.717 | 2.746 | 2.813 | 2.760 | 2.726 |
| 25.5 | 16.000 | 16.000 | 16.000 | 16.000 | 2.664 | 2.690 | 2.719 | 2.669 | 2.657 |
| 26.0 | 16.000 | 16.000 | 16.000 | 16.000 | 2.610 | 2.634 | 2.688 | 2.635 | 2.589 |
| 26.5 | 16.000 | 16.000 | 16.000 | 16.000 | 2.557 | 2.579 | 2.617 | 2.568 | 2.520 |
| 27.0 | 16.000 | 16.000 | 16.000 | 16.000 | 2.503 | 2.523 | 2.547 | 2.501 | 2.451 |
| 27.5 | 16.000 | 16.000 | 16.000 | 16.000 | 2.496 | 2.467 | 2.477 | 2.437 | 2.383 |
| 28.0 | 16.000 | 16.000 | 16.000 | 16.000 | 2.488 | 2.411 | 2.406 | 2.367 | 2.314 |
| 28.5 | 16.000 | 16.000 | 16.000 | 16.000 | 2.481 | 2.355 | 2.336 | 2.303 | 2.246 |
| 29.0 | 16.000 | 16.000 | 16.000 | 16.000 | 2.474 | 2.299 | 2.266 | 2.228 | 2.177 |
| 29.5 | 16.000 | 16.000 | 16.000 | 16.000 | 2.466 | 2.243 | 2.195 | 2.158 | 2.109 |
| 30.0 | 16.000 | 16.000 | 16.000 | 16.000 | 2.459 | 2.188 | 2.125 | 2.089 | 2.040 |
| 30.5 | 16.000 | 16.000 | 16.000 | 16.000 | 2.451 | 2.128 | 2.055 | 2.021 | 1.971 |
| 31.0 | 16.000 | 16.000 | 16.000 | 16.000 | 2.444 | 2.069 | 1.984 | 1.954 | 1.903 |
| 31.5 | 16.000 | 16.000 | 16.000 | 16.000 | 2.437 | 2.009 | 1.914 | 1.880 | 1.834 |
| 32.0 | 16.000 | 16.000 | 16.000 | 16.000 | 2.429 | 1.950 | 1.844 | 1.813 | 1.766 |
| 32.5 | 16.000 | 16.000 | 16.000 | 16.000 | 2.422 | 1.813 | 1.750 | 1.727 | 1.697 |
| 33.0 | 16.000 | 16.000 | 16.000 | 16.000 | 2.415 | 1.727 | 1.656 | 1.638 | 1.628 |
| 33.5 | 16.000 | 16.000 | 16.000 | 16.000 | 2.407 | 1.642 | 1.594 | 1.576 | 1.560 |
| 34.0 | 16.000 | 16.000 | 16.000 | 16.000 | 2.400 | 1.556 | 1.500 | 1.484 | 1.491 |
| 34.5 | 16.000 | 16.000 | 16.000 | 16.000 | 2.392 | 1.471 | 1.438 | 1.424 | 1.423 |
| 35.0 | 16.000 | 16.000 | 16.000 | 16.000 | 2.385 | 1.385 | 1.375 | 1.365 | 1.354 |
| 35.5 | 16.000 | 16.000 | 16.000 | 16.000 | 2.378 | 1.378 | 1.367 | 1.356 | 1.345 |
| 36.0 | 16.000 | 16.000 | 16.000 | 16.000 | 2.370 | 1.370 | 1.359 | 1.348 | 1.337 |
| 36.5 | 16.000 | 16.000 | 16.000 | 16.000 | 2.363 | 1.363 | 1.351 | 1.340 | 1.329 |
| 37.0 | 16.000 | 16.000 | 16.000 | 16.000 | 2.355 | 1.355 | 1.344 | 1.332 | 1.320 |
| 37.5 | 16.000 | 16.000 | 16.000 | 16.000 | 2.348 | 1.348 | 1.336 | 1.324 | 1.312 |
| 38.0 | 16.000 | 16.000 | 16.000 | 16.000 | 2.341 | 1.341 | 1.328 | 1.316 | 1.304 |
| 38.5 | 16.000 | 16.000 | 16.000 | 16.000 | 2.333 | 1.333 | 1.321 | 1.308 | 1.295 |
| 39.0 | 16.000 | 16.000 | 16.000 | 16.000 | 2.326 | 1.326 | 1.313 | 1.300 | 1.287 |
| 39.5 | 16.000 | 16.000 | 16.000 | 16.000 | 2.319 | 1.319 | 1.305 | 1.292 | 1.279 |
| 40.0 | 16.000 | 16.000 | 16.000 | 16.000 | 2.311 | 1.311 | 1.298 | 1.284 | 1.270 |
| 40.5 | 16.000 | 16.000 | 16.000 | 16.000 | 2.304 | 1.304 | 1.290 | 1.276 | 1.262 |
| 41.0 | 16.000 | 16.000 | 16.000 | 16.000 | 2.296 | 1.296 | 1.282 | 1.268 | 1.253 |
| 41.5 | 16.000 | 16.000 | 16.000 | 16.000 | 2.289 | 1.289 | 1.274 | 1.260 | 1.245 |
| 42.0 | 16.000 | 16.000 | 16.000 | 16.000 | 2.282 | 1.282 | 1.267 | 1.252 | 1.237 |
| 42.5 | 16.000 | 16.000 | 16.000 | 16.000 | 2.274 | 1.274 | 1.259 | 1.244 | 1.228 |
| 43.0 | 16.000 | 16.000 | 16.000 | 16.000 | 2.267 | 1.267 | 1.251 | 1.236 | 1.220 |
| 43.5 | 16.000 | 16.000 | 16.000 | 16.000 | 2.259 | 1.259 | 1.244 | 1.228 | 1.212 |
| 44.0 | 16.000 | 16.000 | 16.000 | 16.000 | 2.252 | 1.252 | 1.236 | 1.220 | 1.203 |
| 44.5 | 16.000 | 16.000 | 16.000 | 16.000 | 2.245 | 1.245 | 1.228 | 1.212 | 1.195 |
| 45.0 | 16.000 | 16.000 | 16.000 | 16.000 | 2.237 | 1.237 | 1.220 | 1.203 | 1.187 |
| 45.5 | 16.000 | 16.000 | 16.000 | 16.000 | 2.230 | 1.230 | 1.213 | 1.195 | 1.178 |
| 46.0 | 16.000 | 16.000 | 16.000 | 16.000 | 2.223 | 1.223 | 1.205 | 1.187 | 1.170 |
| 46.5 | 16.000 | 16.000 | 16.000 | 16.000 | 2.215 | 1.215 | 1.197 | 1.179 | 1.161 |
| 47.0 | 16.000 | 16.000 | 16.000 | 16.000 | 2.208 | 1.208 | 1.190 | 1.171 | 1.153 |
| 47.5 | 16.000 | 16.000 | 16.000 | 16.000 | 2.200 | 1.200 | 1.182 | 1.163 | 1.145 |
| 48.0 | 16.000 | 16.000 | 16.000 | 16.000 | 2.193 | 1.193 | 1.174 | 1.155 | 1.136 |
| 48.5 | 16.000 | 16.000 | 16.000 | 16.000 | 2.186 | 1.186 | 1.166 | 1.147 | 1.128 |
| 49.0 | 16.000 | 16.000 | 16.000 | 16.000 | 2.178 | 1.178 | 1.159 | 1.139 | 1.120 |
| 49.5 | 16.000 | 16.000 | 16.000 | 16.000 | 2.171 | 1.171 | 1.151 | 1.131 | 1.111 |
| 50.0 | 16.000 | 16.000 | 16.000 | 16.000 | 2.163 | 1.163 | 1.143 | 1.123 | 1.103 |
| 50.5 | 16.000 | 16.000 | 16.000 | 16.000 | 2.156 | 1.156 | 1.136 | 1.115 | 1.095 |
| 51.0 | 16.000 | 16.000 | 16.000 | 16.000 | 2.149 | 1.149 | 1.128 | 1.107 | 1.086 |
| 51.5 | 16.000 | 16.000 | 16.000 | 16.000 | 2.141 | 1.141 | 1.120 | 1.099 | 1.078 |
| 52.0 | 16.000 | 16.000 | 16.000 | 16.000 | 2.134 | 1.134 | 1.112 | 1.091 | 1.069 |
| 52.5 | 16.000 | 16.000 | 16.000 | 16.000 | 2.127 | 1.127 | 1.105 | 1.083 | 1.061 |
| 53.0 | 16.000 | 16.000 | 16.000 | 16.000 | 2.119 | 1.119 | 1.097 | 1.075 | 1.053 |
| 53.5 | 16.000 | 16.000 | 16.000 | 16.000 | 2.112 | 1.112 | 1.089 | 1.067 | 1.044 |
| 54.0 | 16.000 | 16.000 | 16.000 | 16.000 | 2.104 | 1.104 | 1.082 | 1.059 | 1.036 |
| 54.5 | 16.000 | 16.000 | 16.000 | 16.000 | 2.097 | 1.097 | 1.074 | 1.051 | 1.028 |
| 55.0 | 16.000 | 16.000 | 16.000 | 16.000 | 2.090 | 1.090 | 1.066 | 1.043 | 1.019 |
| 55.5 | 16.000 | 16.000 | 16.000 | 16.000 | 2.082 | 1.082 | 1.058 | 1.035 | 1.011 |
| 56.0 | 16.000 | 16.000 | 16.000 | 16.000 | 2.075 | 1.075 | 1.051 | 1.027 | 1.003 |
| 56.5 | 16.000 | 16.000 | 16.000 | 16.000 | 2.068 | 1.068 | 1.043 | 1.019 | 0.994 |
| 57.0 | 16.000 | 16.000 | 16.000 | 16.000 | 2.060 | 1.060 | 1.035 | 1.011 | 0.986 |
| 57.5 | 16.000 | 16.000 | 16.000 | 16.000 | 2.053 | 1.053 | 1.028 | 1.003 | 0.978 |
| 58.0 | 16.000 | 16.000 | 16.000 | 16.000 | 2.045 | 1.045 | 1.020 | 0.995 | 0.969 |
| 58.5 | 16.000 | 16.000 | 16.000 | 16.000 | 2.038 | 1.038 | 1.012 | 0.987 | 0.961 |
| 59.0 | 16.000 | 16.000 | 16.000 | 16.000 | 2.031 | 1.031 | 1.005 | 0.978 | 0.952 |
| 59.5 | 16.000 | 16.000 | 16.000 | 16.000 | 2.023 | 1.023 | 0.997 | 0.970 | 0.944 |
| 60.0 | 16.000 | 16.000 | 16.000 | 16.000 | 2.016 | 1.016 | 0.989 | 0.962 | 0.936 |
| 60.5 | 16.000 | 16.000 | 16.000 | 16.000 | 2.008 | 1.008 | 0.981 | 0.954 | 0.927 |
| 61.0 | 16.000 | 16.000 | 16.000 | 16.000 | 2.001 | 1.001 | 0.974 | 0.946 | 0.919 |
| 61.5 | 16.000 | 16.000 | 16.000 | 16.000 | 1.994 | 0.994 | 0.966 | 0.938 | 0.911 |

TABLE 1-continued

Top line of each page shows position from center line of tub in inches
Left Column shows distance from head of tub (0.0) to foot of tub (88.0) in inches
Data in table shows height of tub floor at indicated points in inches

| | | | | | | | | | |
|---|---|---|---|---|---|---|---|---|---|
| 62.0 | 16.000 | 16.000 | 16.000 | 16.000 | 1.986 | 0.986 | 0.958 | 0.930 | 0.902 |
| 62.5 | 16.000 | 16.000 | 16.000 | 16.000 | 1.979 | 0.979 | 0.951 | 0.922 | 0.894 |
| 63.0 | 16.000 | 16.000 | 16.000 | 16.000 | 1.972 | 0.972 | 0.943 | 0.914 | 0.886 |
| 63.5 | 16.000 | 16.000 | 16.000 | 16.000 | 1.964 | 0.964 | 0.935 | 0.906 | 0.877 |
| 64.0 | 16.000 | 16.000 | 16.000 | 16.000 | 1.957 | 0.957 | 0.927 | 0.898 | 0.869 |
| 64.5 | 16.000 | 16.000 | 16.000 | 16.000 | 1.949 | 0.949 | 0.920 | 0.890 | 0.860 |
| 65.0 | 16.000 | 16.000 | 16.000 | 16.000 | 1.942 | 0.942 | 0.912 | 0.882 | 0.852 |
| 65.5 | 16.000 | 16.000 | 16.000 | 16.000 | 1.935 | 0.935 | 0.904 | 0.874 | 0.844 |
| 66.0 | 16.000 | 16.000 | 16.000 | 16.000 | 1.927 | 0.927 | 0.897 | 0.866 | 0.835 |
| 66.5 | 16.000 | 16.000 | 16.000 | 16.000 | 1.920 | 0.920 | 0.889 | 0.858 | 0.827 |
| 67.0 | 16.000 | 16.000 | 16.000 | 16.000 | 1.912 | 0.912 | 0.881 | 0.850 | 0.819 |
| 67.5 | 16.000 | 16.000 | 16.000 | 16.000 | 1.905 | 0.905 | 0.873 | 0.842 | 0.810 |
| 68.0 | 16.000 | 16.000 | 16.000 | 16.000 | 1.898 | 0.898 | 0.866 | 0.834 | 0.802 |
| 68.5 | 16.000 | 16.000 | 16.000 | 16.000 | 1.890 | 0.890 | 0.858 | 0.826 | 0.794 |
| 69.0 | 16.000 | 16.000 | 16.000 | 16.000 | 1.883 | 0.883 | 0.850 | 0.818 | 0.785 |
| 69.5 | 16.000 | 16.000 | 16.000 | 16.000 | 1.876 | 0.876 | 0.843 | 0.810 | 0.777 |
| 70.0 | 16.000 | 16.000 | 16.000 | 16.000 | 1.868 | 0.868 | 0.835 | 0.802 | 0.768 |
| 70.5 | 16.000 | 16.000 | 16.000 | 16.000 | 1.861 | 0.861 | 0.827 | 0.794 | 0.760 |
| 71.0 | 16.000 | 16.000 | 16.000 | 16.000 | 1.853 | 0.853 | 0.819 | 0.786 | 0.752 |
| 71.5 | 16.000 | 16.000 | 16.000 | 16.000 | 1.846 | 0.846 | 0.812 | 0.778 | 0.743 |
| 72.0 | 16.000 | 16.000 | 16.000 | 16.000 | 1.839 | 0.839 | 0.804 | 0.770 | 0.735 |
| 72.5 | 16.000 | 16.000 | 16.000 | 16.000 | 1.831 | 0.831 | 0.796 | 0.761 | 0.727 |
| 73.0 | 16.000 | 16.000 | 16.000 | 16.000 | 1.824 | 0.824 | 0.789 | 0.753 | 0.718 |
| 73.5 | 16.000 | 16.000 | 16.000 | 16.000 | 1.816 | 0.816 | 0.781 | 0.745 | 0.710 |
| 74.0 | 16.000 | 16.000 | 16.000 | 16.000 | 1.809 | 0.809 | 0.773 | 0.737 | 0.702 |
| 74.5 | 16.000 | 16.000 | 16.000 | 16.000 | 1.802 | 0.802 | 0.766 | 0.729 | 0.693 |
| 75.0 | 16.000 | 16.000 | 16.000 | 16.000 | 1.794 | 0.794 | 0.758 | 0.721 | 0.685 |
| 75.5 | 16.000 | 16.000 | 16.000 | 16.000 | 1.787 | 0.787 | 0.750 | 0.713 | 0.676 |
| 76.0 | 16.000 | 16.000 | 16.000 | 16.000 | 1.780 | 0.780 | 0.742 | 0.705 | 0.668 |
| 76.5 | 16.000 | 16.000 | 16.000 | 16.000 | 1.772 | 0.772 | 0.735 | 0.697 | 0.660 |
| 77.0 | 16.000 | 16.000 | 16.000 | 16.000 | 1.765 | 0.765 | 0.727 | 0.689 | 0.651 |
| 77.5 | 16.000 | 16.000 | 16.000 | 16.000 | 1.757 | 0.757 | 0.719 | 0.681 | 0.643 |
| 78.0 | 16.000 | 16.000 | 16.000 | 16.000 | 1.750 | 0.750 | 0.712 | 0.673 | 0.635 |
| 78.5 | 16.000 | 16.000 | 16.000 | 16.000 | 1.750 | 0.764 | 0.726 | 0.687 | 0.648 |
| 79.0 | 16.000 | 16.000 | 16.000 | 16.000 | 1.766 | 0.779 | 0.739 | 0.700 | 0.661 |
| 79.5 | 16.000 | 16.000 | 16.000 | 16.090 | 1.781 | 0.793 | 0.753 | 0.714 | 0.675 |
| 80.0 | 16.000 | 16.000 | 16.000 | 16.000 | 1.797 | 0.807 | 0.767 | 0.728 | 0.688 |
| 80.5 | 16.000 | 16.000 | 16.000 | 16.000 | 1.813 | 0.821 | 0.781 | 0.741 | 0.702 |
| 81.0 | 16.000 | 16.000 | 16.000 | 16.000 | 1.828 | 0.836 | 0.795 | 0.755 | 0.715 |
| 81.5 | 16.000 | 16.000 | 16.000 | 16.000 | 1.844 | 0.850 | 0.809 | 0.769 | 0.728 |
| 82.0 | 16.000 | 16.000 | 16.000 | 16.000 | 1.860 | 0.864 | 0.823 | 0.783 | 0.742 |
| 82.5 | 16.000 | 16.000 | 16.000 | 16.000 | 1.875 | 0.878 | 0.837 | 0.796 | 0.755 |
| 83.0 | 16.000 | 16.000 | 16.000 | 16.000 | 1.891 | 0.893 | 0.851 | 0.810 | 0.768 |
| 83.5 | 16.000 | 16.000 | 16.000 | 16.000 | 1.907 | 0.907 | 0.865 | 0.824 | 0.782 |
| 84.0 | 16.000 | 16.000 | 16.000 | 16.000 | 1.907 | 1.907 | 1.865 | 1.823 | 1.782 |
| 84.5 | 16.000 | 16.000 | 16.000 | 16.000 | 16.000 | 16.000 | 16.000 | 16.000 | 16.000 |
| 85.0 | 16.000 | 16.000 | 16.000 | 16.000 | 16.000 | 16.000 | 16.000 | 16.000 | 16.000 |
| 85.5 | 16.000 | 16.000 | 16.000 | 16.000 | 16.000 | 16.000 | 16.000 | 16.000 | 16.000 |
| 86.0 | 16.000 | 16.000 | 16.000 | 16.000 | 16.000 | 16.000 | 16.000 | 16.000 | 16.000 |
| 86.5 | 16.000 | 16.000 | 16.000 | 16.000 | 16.000 | 16.000 | 16.000 | 16.000 | 16.000 |
| 87.0 | 16.000 | 16.000 | 16.000 | 16.000 | 16.000 | 16.000 | 16.000 | 16.000 | 16.000 |
| 87.5 | 16.000 | 16.000 | 16.000 | 16.000 | 16.000 | 16.000 | 16.000 | 16.000 | 16.000 |
| 88.0 | 16.000 | 16.000 | 16.000 | 16.000 | 16.000 | 16.000 | 16.000 | 16.000 | 16.000 |

| | −9.0 | −8.0 | −7.0 | −6.0 | −5.0 | −4.0 | −3.0 | −2.0 | −1.0 |
|---|---|---|---|---|---|---|---|---|---|
| 0.0 | 16.000 | 16.000 | 16.000 | 16.000 | 16.000 | 16.000 | 16.000 | 16.000 | 16.000 |
| 0.5 | 16.000 | 16.000 | 16.000 | 16.000 | 16.000 | 16.000 | 16.000 | 16.000 | 16.000 |
| 1.0 | 16.000 | 16.000 | 16.000 | 16.000 | 16.000 | 16.000 | 16.000 | 16.000 | 16.000 |
| 1.5 | 16.000 | 16.000 | 16.000 | 16.000 | 16.000 | 16.000 | 16.000 | 16.000 | 16.000 |
| 2.0 | 16.000 | 16.000 | 16.000 | 16.000 | 16.000 | 16.000 | 16.000 | 16.000 | 16.000 |
| 2.5 | 16.000 | 16.000 | 16.000 | 16.000 | 16.000 | 16.000 | 16.000 | 16.000 | 16.000 |
| 3.0 | 16.000 | 16.000 | 16.000 | 16.000 | 16.000 | 16.000 | 16.000 | 16.000 | 16.000 |
| 3.5 | 8.000 | 8.000 | 8.000 | 8.000 | 8.000 | 8.000 | 8.000 | 8.000 | 8.000 |
| 4.0 | 7.875 | 7.875 | 7.875 | 7.875 | 7.875 | 7.875 | 7.875 | 7.875 | 7.875 |
| 4.5 | 7.813 | 7.813 | 7.813 | 7.813 | 7.813 | 7.813 | 7.813 | 7.813 | 7.813 |
| 5.0 | 7.813 | 7.813 | 7.813 | 7.813 | 7.813 | 7.813 | 7.813 | 7.625 | 7.250 |
| 5.5 | 7.813 | 7.813 | 7.813 | 7.813 | 7.813 | 7.813 | 7.813 | 7.125 | 6.688 |
| 6.0 | 7.813 | 7.813 | 7.813 | 7.813 | 7.813 | 7.813 | 7.813 | 6.563 | 6.000 |
| 6.5 | 7.813 | 7.813 | 7.813 | 7.813 | 7.813 | 7.813 | 7.063 | 6.000 | 5.375 |
| 7.0 | 7.813 | 7.813 | 7.813 | 7.813 | 7.813 | 7.813 | 6.625 | 5.438 | 5.000 |
| 7.5 | 7.813 | 7.813 | 7.813 | 7.813 | 7.813 | 7.813 | 6.313 | 5.125 | 4.750 |
| 8.0 | 7.813 | 7.813 | 7.813 | 7.813 | 7.813 | 7.813 | 5.875 | 4.813 | 4.563 |
| 8.5 | 7.813 | 7.813 | 7.813 | 7.813 | 7.813 | 7.813 | 5.500 | 4.625 | 4.563 |
| 9.0 | 7.813 | 7.813 | 7.813 | 7.813 | 7.563 | 6.938 | 5.156 | 4.500 | 4.542 |

TABLE 1-continued

Top line of each page shows position from center line of tub in inches
Left Column shows distance from head of tub (0.0) to foot of tub (88.0) in inches
Data in table shows height of tub floor at indicated points in inches

| | | | | | | | | | |
|---|---|---|---|---|---|---|---|---|---|
| 9.5 | 7.563 | 7.625 | 7.625 | 7.625 | 7.438 | 6.438 | 4.813 | 4.469 | 4.521 |
| 10.0 | 7.188 | 7.000 | 6.938 | 6.750 | 6.438 | 5.750 | 4.563 | 4.438 | 4.500 |
| 10.5 | 6.063 | 6.000 | 5.844 | 5.563 | 5.438 | 4.969 | 4.438 | 4.406 | 4.479 |
| 11.0 | 4.938 | 4.813 | 4.563 | 4.438 | 4.438 | 4.375 | 4.406 | 4.375 | 4.458 |
| 11.5 | 4.250 | 4.250 | 4.263 | 4.275 | 4.288 | 4.300 | 4.313 | 4.438 | 4.438 |
| 12.0 | 4.250 | 4.250 | 4.438 | 4.625 | 4.813 | 4.875 | 4.750 | 4.500 | 4.500 |
| 12.5 | 4.875 | 5.375 | 5.750 | 5.938 | 6.000 | 5.938 | 5.656 | 4.813 | 4.625 |
| 13.0 | 6.313 | 6.563 | 6.875 | 6.813 | 6.938 | 6.750 | 6.313 | 5.563 | 4.938 |
| 13.5 | 7.000 | 7.250 | 7.500 | 7.625 | 7.500 | 7.375 | 6.844 | 6.125 | 5.500 |
| 14.0 | 7.375 | 7.656 | 7.750 | 7.813 | 7.813 | 7.625 | 7.063 | 6.500 | 6.000 |
| 14.5 | 7.500 | 7.688 | 7.750 | 7.813 | 7.813 | 7.688 | 7.125 | 6.625 | 6.375 |
| 15.0 | 7.438 | 7.563 | 7.563 | 7.625 | 7.563 | 7.500 | 7.063 | 6.625 | 6.438 |
| 15.5 | 7.125 | 7.188 | 7.188 | 7.344 | 7.125 | 7.125 | 6.750 | 6.500 | 6.250 |
| 16.0 | 6.625 | 6.688 | 6.750 | 6.750 | 6.688 | 6.594 | 6.375 | 6.188 | 6.000 |
| 16.5 | 6.125 | 6.156 | 6.125 | 6.063 | 6.125 | 6.156 | 5.875 | 5.688 | 5.688 |
| 17.0 | 5.625 | 5.688 | 5.625 | 5.563 | 5.563 | 5.625 | 5.375 | 5.250 | 5.375 |
| 17.5 | 5.188 | 5.188 | 5.125 | 5.125 | 5.094 | 5.094 | 4.906 | 4.750 | 4.969 |
| 18.0 | 4.813 | 4.813 | 4.688 | 4.625 | 4.625 | 4.625 | 4.438 | 4.406 | 4.563 |
| 18.5 | 4.500 | 4.375 | 4.250 | 4.313 | 4.250 | 4.250 | 4.125 | 4.063 | 4.188 |
| 19.0 | 4.188 | 4.125 | 4.000 | 3.938 | 3.938 | 3.875 | 3.750 | 3.750 | 3.875 |
| 19.5 | 3.938 | 3.875 | 3.688 | 3.688 | 3.688 | 3.625 | 3.500 | 3.500 | 3.563 |
| 20.0 | 3.750 | 3.625 | 3.500 | 3.500 | 3.438 | 3.406 | 3.375 | 3.313 | 3.375 |
| 20.5 | 3.563 | 3.438 | 3.313 | 3.250 | 3.250 | 3.250 | 3.188 | 3.188 | 3.188 |
| 21.0 | 3.375 | 3.250 | 3.125 | 3.125 | 3.063 | 3.031 | 3.000 | 3.000 | 3.031 |
| 21.5 | 3.188 | 3.063 | 3.000 | 2.938 | 2.938 | 2.875 | 2.844 | 2.938 | 2.875 |
| 22.0 | 3.063 | 2.938 | 2.875 | 2.813 | 2.813 | 2.750 | 2.750 | 2.750 | 2.750 |
| 22.5 | 2.875 | 2.813 | 2.750 | 2.625 | 2.625 | 2.625 | 2.625 | 2.625 | 2.625 |
| 23.0 | 2.813 | 2.688 | 2.625 | 2.563 | 2.563 | 2.500 | 2.500 | 2.500 | 2.500 |
| 23.5 | 2.751 | 2.631 | 2.571 | 2.510 | 2.510 | 2.450 | 2.449 | 2.449 | 2.448 |
| 24.0 | 2.690 | 2.575 | 2.516 | 2.458 | 2.457 | 2.399 | 2.398 | 2.398 | 2.397 |
| 24.5 | 2.629 | 2.518 | 2.463 | 2.406 | 2.405 | 2.349 | 2.348 | 2.346 | 2.345 |
| 25.0 | 2.568 | 2.462 | 2.408 | 2.354 | 2.352 | 2.299 | 2.297 | 2.295 | 2.293 |
| 25.5 | 2.507 | 2.405 | 2.354 | 2.302 | 2.300 | 2.248 | 2.246 | 2.244 | 2.242 |
| 26.0 | 2.445 | 2.349 | 2.299 | 2.250 | 2.247 | 2.198 | 2.195 | 2.193 | 2.190 |
| 26.5 | 2.384 | 2.293 | 2.245 | 2.198 | 2.195 | 2.148 | 2.145 | 2.141 | 2.138 |
| 27.0 | 2.323 | 2.236 | 2.191 | 2.146 | 2.142 | 2.097 | 2.094 | 2.090 | 2.087 |
| 27.5 | 2.262 | 2.180 | 2.137 | 2.094 | 2.090 | 2.047 | 2.043 | 2.039 | 2.035 |
| 28.0 | 2.201 | 2.123 | 2.082 | 2.042 | 2.037 | 1.997 | 1.992 | 1.988 | 1.984 |
| 28.5 | 2.139 | 2.067 | 2.028 | 1.990 | 1.985 | 1.946 | 1.941 | 1.937 | 1.932 |
| 29.0 | 2.078 | 2.010 | 1.974 | 1.938 | 1.932 | 1.896 | 1.891 | 1.885 | 1.880 |
| 29.5 | 2.017 | 1.954 | 1.920 | 1.885 | 1.880 | 1.845 | 1.840 | 1.834 | 1.829 |
| 30.0 | 1.956 | 1.898 | 1.865 | 1.833 | 1.827 | 1.795 | 1.789 | 1.783 | 1.777 |
| 30.5 | 1.895 | 1.841 | 1.811 | 1.781 | 1.775 | 1.745 | 1.738 | 1.732 | 1.725 |
| 31.0 | 1.833 | 1.785 | 1.757 | 1.729 | 1.722 | 1.694 | 1.688 | 1.681 | 1.674 |
| 31.5 | 1.772 | 1.728 | 1.703 | 1.677 | 1.670 | 1.644 | 1.637 | 1.629 | 1.622 |
| 32.0 | 1.711 | 1.672 | 1.648 | 1.625 | 1.617 | 1.594 | 1.586 | 1.578 | 1.570 |
| 32.5 | 1.650 | 1.615 | 1.594 | 1.573 | 1.565 | 1.543 | 1.535 | 1.527 | 1.519 |
| 33.0 | 1.589 | 1.559 | 1.540 | 1.521 | 1.512 | 1.493 | 1.484 | 1.476 | 1.467 |
| 33.5 | 1.527 | 1.503 | 1.486 | 1.469 | 1.460 | 1.443 | 1.434 | 1.424 | 1.415 |
| 34.0 | 1.466 | 1.446 | 1.431 | 1.417 | 1.407 | 1.392 | 1.383 | 1.373 | 1.364 |
| 34.5 | 1.405 | 1.390 | 1.377 | 1.365 | 1.355 | 1.342 | 1.332 | 1.322 | 1.312 |
| 35.0 | 1.344 | 1.333 | 1.323 | 1.313 | 1.302 | 1.292 | 1.281 | 1.271 | 1.260 |
| 35.5 | 1.335 | 1.324 | 1.313 | 1.303 | 1.292 | 1.281 | 1.271 | 1.260 | 1.249 |
| 36.0 | 1.326 | 1.315 | 1.304 | 1.293 | 1.282 | 1.271 | 1.260 | 1.249 | 1.238 |
| 36.5 | 1.317 | 1.306 | 1.295 | 1.283 | 1.272 | 1.261 | 1.249 | 1.238 | 1.226 |
| 37.0 | 1.309 | 1.297 | 1.285 | 1.274 | 1.262 | 1.250 | 1.239 | 1.227 | 1.215 |
| 37.5 | 1.300 | 1.288 | 1.276 | 1.264 | 1.252 | 1.240 | 1.228 | 1.216 | 1.204 |
| 38.0 | 1.291 | 1.279 | 1.267 | 1.254 | 1.242 | 1.230 | 1.217 | 1.205 | 1.193 |
| 38.5 | 1.283 | 1.270 | 1.257 | 1.245 | 1.232 | 1.219 | 1.207 | 1.194 | 1.181 |
| 39.0 | 1.274 | 1.261 | 1.248 | 1.235 | 1.222 | 1.209 | 1.196 | 1.183 | 1.170 |
| 39.5 | 1.265 | 1.252 | 1.239 | 1.225 | 1.212 | 1.199 | 1.185 | 1.172 | 1.159 |
| 40.0 | 1.257 | 1.243 | 1.229 | 1.216 | 1.202 | 1.188 | 1.175 | 1.161 | 1.147 |
| 40.5 | 1.248 | 1.234 | 1.220 | 1.206 | 1.192 | 1.178 | 1.164 | 1.150 | 1.136 |
| 41.0 | 1.239 | 1.225 | 1.211 | 1.196 | 1.182 | 1.168 | 1.153 | 1.139 | 1.125 |
| 41.5 | 1.230 | 1.216 | 1.201 | 1.187 | 1.172 | 1.157 | 1.143 | 1.128 | 1.113 |
| 42.0 | 1.222 | 1.207 | 1.192 | 1.177 | 1.162 | 1.147 | 1.132 | 1.117 | 1.102 |
| 42.5 | 1.213 | 1.198 | 1.183 | 1.167 | 1.152 | 1.137 | 1.121 | 1.106 | 1.091 |
| 43.0 | 1.204 | 1.189 | 1.173 | 1.158 | 1.142 | 1.126 | 1.111 | 1.095 | 1.080 |
| 43.5 | 1.196 | 1.180 | 1.164 | 1.148 | 1.132 | 1.116 | 1.100 | 1.084 | 1.068 |
| 44.0 | 1.187 | 1.171 | 1.155 | 1.138 | 1.122 | 1.106 | 1.089 | 1.073 | 1.057 |
| 44.5 | 1.178 | 1.162 | 1.145 | 1.129 | 1.112 | 1.095 | 1.079 | 1.062 | 1.046 |
| 45.0 | 1.170 | 1.153 | 1.136 | 1.119 | 1.102 | 1.085 | 1.068 | 1.051 | 1.034 |
| 45.5 | 1.161 | 1.144 | 1.126 | 1.109 | 1.092 | 1.075 | 1.058 | 1.040 | 1.023 |
| 46.0 | 1.152 | 1.135 | 1.117 | 1.100 | 1.082 | 1.064 | 1.047 | 1.029 | 1.012 |
| 46.5 | 1.144 | 1.126 | 1.108 | 1.090 | 1.072 | 1.054 | 1.036 | 1.018 | 1.000 |

TABLE 1-continued

Top line of each page shows position from center line of tub in inches
Left Column shows distance from head of tub (0.0) to foot of tub (88.0) in inches
Data in table shows height of tub floor at indicated points in inches

| | | | | | | | | | |
|---|---|---|---|---|---|---|---|---|---|
| 47.0 | 1.135 | 1.117 | 1.098 | 1.080 | 1.062 | 1.044 | 1.026 | 1.007 | 0.989 |
| 47.5 | 1.126 | 1.108 | 1.089 | 1.071 | 1.052 | 1.033 | 1.015 | 0.996 | 0.978 |
| 48.0 | 1.118 | 1.099 | 1.080 | 1.061 | 1.042 | 1.023 | 1.004 | 0.985 | 0.967 |
| 48.5 | 1.109 | 1.090 | 1.070 | 1.051 | 1.032 | 1.013 | 0.994 | 0.974 | 0.955 |
| 49.0 | 1.100 | 1.081 | 1.061 | 1.042 | 1.022 | 1.003 | 0.983 | 0.963 | 0.944 |
| 49.5 | 1.091 | 1.072 | 1.052 | 1.032 | 1.012 | 0.992 | 0.972 | 0.952 | 0.933 |
| 50.0 | 1.083 | 1.063 | 1.042 | 1.022 | 1.002 | 0.982 | 0.962 | 0.942 | 0.921 |
| 50.5 | 1.074 | 1.054 | 1.033 | 1.013 | 0.992 | 0.972 | 0.951 | 0.931 | 0.910 |
| 51.0 | 1.065 | 1.045 | 1.024 | 1.003 | 0.982 | 0.961 | 0.940 | 0.920 | 0.899 |
| 51.5 | 1.057 | 1.036 | 1.014 | 0.993 | 0.972 | 0.951 | 0.930 | 0.909 | 0.887 |
| 52.0 | 1.048 | 1.027 | 1.005 | 0.984 | 0.962 | 0.941 | 0.919 | 0.898 | 0.876 |
| 52.5 | 1.039 | 1.018 | 0.996 | 0.974 | 0.952 | 0.930 | 0.908 | 0.887 | 0.865 |
| 53.0 | 1.031 | 1.008 | 0.986 | 0.964 | 0.942 | 0.920 | 0.898 | 0.876 | 0.854 |
| 53.5 | 1.022 | 0.999 | 0.977 | 0.955 | 0.932 | 0.910 | 0.887 | 0.865 | 0.842 |
| 54.0 | 1.013 | 0.990 | 0.968 | 0.945 | 0.922 | 0.899 | 0.877 | 0.854 | 0.831 |
| 54.5 | 1.005 | 0.981 | 0.958 | 0.935 | 0.912 | 0.889 | 0.866 | 0.843 | 0.820 |
| 55.0 | 0.996 | 0.972 | 0.949 | 0.926 | 0.902 | 0.879 | 0.855 | 0.832 | 0.808 |
| 55.5 | 0.987 | 0.963 | 0.940 | 0.916 | 0.892 | 0.868 | 0.845 | 0.821 | 0.797 |
| 56.0 | 0.978 | 0.954 | 0.930 | 0.906 | 0.882 | 0.858 | 0.834 | 0.810 | 0.786 |
| 56.5 | 0.970 | 0.945 | 0.921 | 0.897 | 0.872 | 0.848 | 0.823 | 0.799 | 0.774 |
| 57.0 | 0.961 | 0.936 | 0.912 | 0.887 | 0.862 | 0.837 | 0.813 | 0.788 | 0.763 |
| 57.5 | 0.952 | 0.927 | 0.902 | 0.877 | 0.852 | 0.827 | 0.802 | 0.777 | 0.752 |
| 58.0 | 0.944 | 0.918 | 0.893 | 0.868 | 0.842 | 0.817 | 0.791 | 0.766 | 0.741 |
| 58.5 | 0.935 | 0.909 | 0.884 | 0.858 | 0.832 | 0.806 | 0.781 | 0.755 | 0.729 |
| 59.0 | 0.926 | 0.900 | 0.874 | 0.848 | 0.822 | 0.796 | 0.770 | 0.744 | 0.718 |
| 59.5 | 0.918 | 0.891 | 0.865 | 0.839 | 0.812 | 0.786 | 0.759 | 0.733 | 0.707 |
| 60.0 | 0.909 | 0.882 | 0.856 | 0.829 | 0.802 | 0.775 | 0.749 | 0.722 | 0.695 |
| 60.5 | 0.900 | 0.873 | 0.846 | 0.819 | 0.792 | 0.765 | 0.738 | 0.711 | 0.684 |
| 61.0 | 0.892 | 0.864 | 0.837 | 0.810 | 0.782 | 0.755 | 0.727 | 0.700 | 0.673 |
| 61.5 | 0.883 | 0.855 | 0.828 | 0.800 | 0.772 | 0.744 | 0.717 | 0.689 | 0.661 |
| 62.0 | 0.874 | 0.846 | 0.818 | 0.790 | 0.762 | 0.734 | 0.706 | 0.678 | 0.650 |
| 62.5 | 0.866 | 0.837 | 0.809 | 0.781 | 0.752 | 0.724 | 0.695 | 0.667 | 0.639 |
| 63.0 | 0.857 | 0.828 | 0.800 | 0.771 | 0.742 | 0.714 | 0.685 | 0.656 | 0.628 |
| 63.5 | 0.848 | 0.819 | 0.790 | 0.761 | 0.732 | 0.703 | 0.674 | 0.645 | 0.616 |
| 64.0 | 0.839 | 0.810 | 0.781 | 0.752 | 0.722 | 0.693 | 0.664 | 0.634 | 0.605 |
| 64.5 | 0.831 | 0.801 | 0.771 | 0.742 | 0.712 | 0.683 | 0.653 | 0.623 | 0.594 |
| 65.0 | 0.822 | 0.792 | 0.762 | 0.732 | 0.702 | 0.672 | 0.642 | 0.612 | 0.582 |
| 65.5 | 0.813 | 0.783 | 0.753 | 0.722 | 0.692 | 0.662 | 0.632 | 0.601 | 0.571 |
| 66.0 | 0.805 | 0.774 | 0.743 | 0.713 | 0.682 | 0.652 | 0.621 | 0.590 | 0.560 |
| 66.5 | 0.796 | 0.765 | 0.734 | 0.703 | 0.672 | 0.641 | 0.610 | 0.579 | 0.548 |
| 67.0 | 0.787 | 0.756 | 0.725 | 0.693 | 0.662 | 0.631 | 0.600 | 0.568 | 0.537 |
| 67.5 | 0.779 | 0.747 | 0.715 | 0.684 | 0.652 | 0.621 | 0.589 | 0.557 | 0.526 |
| 68.0 | 0.770 | 0.738 | 0.706 | 0.674 | 0.642 | 0.610 | 0.578 | 0.546 | 0.514 |
| 68.5 | 0.761 | 0.729 | 0.697 | 0.664 | 0.632 | 0.600 | 0.568 | 0.535 | 0.503 |
| 69.0 | 0.753 | 0.720 | 0.687 | 0.655 | 0.622 | 0.590 | 0.557 | 0.524 | 0.492 |
| 69.5 | 0.744 | 0.711 | 0.678 | 0.645 | 0.612 | 0.579 | 0.546 | 0.513 | 0.481 |
| 70.0 | 0.735 | 0.702 | 0.669 | 0.635 | 0.602 | 0.569 | 0.536 | 0.503 | 0.469 |
| 70.5 | 0.726 | 0.693 | 0.659 | 0.626 | 0.592 | 0.559 | 0.525 | 0.492 | 0.458 |
| 71.0 | 0.718 | 0.684 | 0.650 | 0.616 | 0.582 | 0.548 | 0.514 | 0.481 | 0.447 |
| 71.5 | 0.709 | 0.675 | 0.641 | 0.606 | 0.572 | 0.538 | 0.504 | 0.470 | 0.435 |
| 72.0 | 0.700 | 0.666 | 0.631 | 0.597 | 0.562 | 0.528 | 0.493 | 0.459 | 0.424 |
| 72.5 | 0.692 | 0.657 | 0.622 | 0.587 | 0.552 | 0.517 | 0.483 | 0.448 | 0.413 |
| 73.0 | 0.683 | 0.648 | 0.613 | 0.577 | 0.542 | 0.507 | 0.472 | 0.437 | 0.401 |
| 73.5 | 0.674 | 0.639 | 0.603 | 0.568 | 0.532 | 0.497 | 0.461 | 0.426 | 0.390 |
| 74.0 | 0.666 | 0.630 | 0.594 | 0.558 | 0.522 | 0.486 | 0.451 | 0.415 | 0.379 |
| 74.5 | 0.657 | 0.621 | 0.585 | 0.548 | 0.512 | 0.476 | 0.440 | 0.404 | 0.368 |
| 75.0 | 0.648 | 0.612 | 0.575 | 0.539 | 0.502 | 0.466 | 0.429 | 0.393 | 0.356 |
| 75.5 | 0.640 | 0.603 | 0.566 | 0.529 | 0.492 | 0.455 | 0.419 | 0.382 | 0.345 |
| 76.0 | 0.631 | 0.594 | 0.557 | 0.519 | 0.482 | 0.445 | 0.408 | 0.371 | 0.334 |
| 76.5 | 0.622 | 0.585 | 0.547 | 0.510 | 0.472 | 0.435 | 0.397 | 0.360 | 0.322 |
| 77.0 | 0.614 | 0.576 | 0.538 | 0.500 | 0.462 | 0.424 | 0.387 | 0.349 | 0.311 |
| 77.5 | 0.605 | 0.567 | 0.529 | 0.490 | 0.452 | 0.414 | 0.376 | 0.338 | 0.300 |
| 78.0 | 0.596 | 0.558 | 0.519 | 0.481 | 0.442 | 0.404 | 0.365 | 0.327 | 0.288 |
| 78.5 | 0.609 | 0.570 | 0.532 | 0.493 | 0.454 | 0.415 | 0.377 | 0.338 | 0.299 |
| 79.0 | 0.622 | 0.583 | 0.544 | 0.505 | 0.466 | 0.427 | 0.388 | 0.349 | 0.310 |
| 79.5 | 0.635 | 0.596 | 0.557 | 0.517 | 0.478 | 0.439 | 0.399 | 0.360 | 0.321 |
| 80.0 | 0.649 | 0.609 | 0.569 | 0.530 | 0.490 | 0.450 | 0.411 | 0.371 | 0.331 |
| 80.5 | 0.662 | 0.622 | 0.582 | 0.542 | 0.502 | 0.462 | 0.422 | 0.382 | 0.342 |
| 81.0 | 0.675 | 0.634 | 0.594 | 0.554 | 0.514 | 0.474 | 0.433 | 0.393 | 0.353 |
| 81.5 | 0.688 | 0.647 | 0.607 | 0.566 | 0.526 | 0.485 | 0.445 | 0.404 | 0.364 |
| 82.0 | 0.701 | 0.660 | 0.619 | 0.578 | 0.538 | 0.497 | 0.456 | 0.415 | 0.374 |
| 82.5 | 0.714 | 0.673 | 0.632 | 0.591 | 0.550 | 0.508 | 0.467 | 0.426 | 0.385 |
| 83.0 | 0.727 | 0.686 | 0.644 | 0.603 | 0.562 | 0.520 | 0.479 | 0.437 | 0.396 |
| 83.5 | 0.740 | 0.699 | 0.657 | 0.615 | 0.573 | 0.532 | 0.490 | 0.448 | 0.407 |
| 84.0 | 1.740 | 1.698 | 1.657 | 1.615 | 0.573 | 1.532 | 1.490 | 1.448 | 1.407 |

TABLE 1-continued

Top line of each page shows position from center line of tub in inches
Left Column shows distance from head of tub (0.0) to foot of tub (88.0) in inches
Data in table shows height of tub floor at indicated points in inches

| | | | | | | | | | |
|---|---|---|---|---|---|---|---|---|---|
| 84.5 | 16.000 | 16.000 | 16.000 | 16.000 | 16.000 | 16.000 | 16.000 | 16.000 | 16.000 |
| 85.0 | 16.000 | 16.000 | 16.000 | 16.000 | 16.000 | 16.000 | 16.000 | 16.000 | 16.000 |
| 85.5 | 16.000 | 16.000 | 16.000 | 16.000 | 16.000 | 16.000 | 16.000 | 16.000 | 16.000 |
| 86.0 | 16.000 | 16.000 | 16.000 | 16.000 | 16.000 | 16.000 | 16.000 | 16.000 | 16.000 |
| 86.5 | 16.000 | 16.000 | 16.000 | 16.000 | 16.000 | 16.000 | 16.000 | 16.000 | 16.000 |
| 87.0 | 16.000 | 16.000 | 16.000 | 16.000 | 16.000 | 16.000 | 16.000 | 16.000 | 16.000 |
| 87.5 | 16.000 | 16.000 | 16.000 | 16.000 | 16.000 | 16.000 | 16.000 | 16.000 | 16.000 |
| 88.0 | 16.000 | 16.000 | 16.000 | 16.000 | 16.000 | 16.000 | 16.000 | 16.000 | 16.000 |
| | 0.0 | 1.0 | 2.0 | 3.0 | 4.0 | 5.0 | 6.0 | 7.0 | 8.0 |
| 0.0 | 16.000 | 16.000 | 16.000 | 16.000 | 16.000 | 16.000 | 16.000 | 16.000 | 16.000 |
| 0.5 | 16.000 | 16.000 | 16.000 | 16.000 | 16.000 | 16.000 | 16.000 | 16.000 | 16.000 |
| 1.0 | 16.000 | 16.000 | 16.000 | 16.000 | 16.000 | 16.000 | 16.000 | 16.000 | 16.000 |
| 1.5 | 16.000 | 16.000 | 16.000 | 16.000 | 16.000 | 16.000 | 16.000 | 16.000 | 16.000 |
| 2.0 | 16.000 | 16.000 | 16.000 | 16.000 | 16.000 | 16.000 | 16.000 | 16.000 | 16.000 |
| 2.5 | 16.000 | 16.000 | 16.000 | 16.000 | 16.000 | 16.000 | 16.000 | 16.000 | 16.000 |
| 3.0 | 16.000 | 16.000 | 16.000 | 16.000 | 16.000 | 16.000 | 16.000 | 16.000 | 16.000 |
| 3.5 | 8.000 | 8.000 | 8.000 | 8.000 | 8.000 | 8.000 | 8.000 | 8.000 | 8.000 |
| 4.0 | 7.875 | 7.875 | 7.875 | 7.875 | 7.875 | 7.875 | 7.875 | 7.875 | 7.875 |
| 4.5 | 7.813 | 7.813 | 7.813 | 7.813 | 7.813 | 7.813 | 7.813 | 7.813 | 7.813 |
| 5.0 | 7.125 | 7.250 | 7.625 | 7.813 | 7.813 | 7.813 | 7.813 | 7.813 | 7.813 |
| 5.5 | 6.625 | 6.688 | 7.125 | 7.813 | 7.813 | 7.813 | 7.813 | 7.813 | 7.813 |
| 6.0 | 5.983 | 6.000 | 6.563 | 7.813 | 7.813 | 7.813 | 7.813 | 7.813 | 7.813 |
| 6.5 | 5.375 | 5.375 | 6.000 | 7.063 | 7.813 | 7.813 | 7.813 | 7.813 | 7.813 |
| 7.0 | 4.750 | 5.000 | 5.438 | 6.625 | 7.813 | 7.813 | 7.813 | 7.813 | 7.813 |
| 7.5 | 4.500 | 4.750 | 5.125 | 6.313 | 7.813 | 7.813 | 7.813 | 7.813 | 7.813 |
| 8.0 | 4.500 | 4.563 | 4.813 | 5.875 | 7.813 | 7.813 | 7.813 | 7.813 | 7.813 |
| 8.5 | 4.438 | 4.563 | 4.625 | 5.500 | 7.813 | 7.813 | 7.813 | 7.813 | 7.813 |
| 9.0 | 4.438 | 4.542 | 4.500 | 5.156 | 6.938 | 7.563 | 7.813 | 7.813 | 7.813 |
| 9.5 | 4.438 | 4.521 | 4.469 | 4.813 | 6.438 | 7.438 | 7.625 | 7.625 | 7.625 |
| 10.0 | 4.438 | 4.500 | 4.438 | 4.563 | 5.750 | 6.438 | 6.750 | 6.938 | 7.000 |
| 10.5 | 4.438 | 4.479 | 4.406 | 4.438 | 4.969 | 5.438 | 5.563 | 5.844 | 6.000 |
| 11.0 | 4.375 | 4.458 | 4.375 | 4.406 | 4.375 | 4.438 | 4.438 | 4.563 | 4.813 |
| 11.5 | 4.375 | 4.438 | 4.438 | 4.313 | 4.300 | 4.288 | 4.275 | 4.263 | 4.250 |
| 12.0 | 4.438 | 4.500 | 4.500 | 4.750 | 4.875 | 4.813 | 4.625 | 4.438 | 4.250 |
| 12.5 | 4.438 | 4.625 | 4.813 | 5.656 | 5.938 | 6.000 | 5.938 | 5.750 | 5.375 |
| 13.0 | 4.469 | 4.938 | 5.563 | 6.313 | 6.750 | 6.938 | 6.813 | 6.875 | 6.563 |
| 13.5 | 5.250 | 5.500 | 6.125 | 6.844 | 7.375 | 7.500 | 7.625 | 7.500 | 7.250 |
| 14.0 | 5.875 | 6.000 | 6.500 | 7.063 | 7.625 | 7.813 | 7.813 | 7.750 | 7.656 |
| 14.5 | 6.063 | 6.375 | 6.625 | 7.125 | 7.688 | 7.813 | 7.813 | 7.750 | 7.688 |
| 15.0 | 6.125 | 6.438 | 6.625 | 7.063 | 7.500 | 7.563 | 7.625 | 7.563 | 7.563 |
| 15.5 | 6.188 | 6.250 | 6.500 | 6.750 | 7.125 | 7.125 | 7.344 | 7.188 | 7.188 |
| 16.0 | 6.000 | 6.000 | 6.188 | 6.375 | 6.594 | 6.688 | 6.750 | 6.750 | 6.688 |
| 16.5 | 5.656 | 5.688 | 5.688 | 5.875 | 6.156 | 6.125 | 6.063 | 6.125 | 6.156 |
| 17.0 | 5.313 | 5.375 | 5.250 | 5.375 | 5.625 | 5.563 | 5.563 | 5.625 | 5.688 |
| 17.5 | 4.938 | 4.969 | 4.750 | 4.906 | 5.094 | 5.094 | 5.125 | 5.125 | 5.188 |
| 18.0 | 4.500 | 4.563 | 4.406 | 4.438 | 4.625 | 4.625 | 4.625 | 4.688 | 4.813 |
| 18.5 | 4.250 | 4.188 | 4.063 | 4.125 | 4.250 | 4.250 | 4.313 | 4.250 | 4.375 |
| 19.0 | 3.906 | 3.875 | 3.750 | 3.750 | 3.875 | 3.938 | 3.938 | 4.000 | 4.125 |
| 19.5 | 3.625 | 3.563 | 3.500 | 3.500 | 3.625 | 3.688 | 3.688 | 3.688 | 3.875 |
| 20.0 | 3.375 | 3.375 | 3.313 | 3.375 | 3.406 | 3.438 | 3.500 | 3.500 | 3.625 |
| 20.5 | 3.188 | 3.188 | 3.188 | 3.188 | 3.250 | 3.250 | 3.250 | 3.313 | 3.438 |
| 21.0 | 3.063 | 3.031 | 3.000 | 3.000 | 3.031 | 3.063 | 3.125 | 3.125 | 3.250 |
| 21.5 | 2.938 | 2.875 | 2.938 | 2.844 | 2.875 | 2.938 | 2.938 | 3.000 | 3.063 |
| 22.0 | 2.750 | 2.750 | 2.750 | 2.750 | 2.750 | 2.813 | 2.813 | 2.875 | 2.938 |
| 22.5 | 2.656 | 2.625 | 2.625 | 2.625 | 2.625 | 2.625 | 2.625 | 2.750 | 2.813 |
| 23.0 | 2.563 | 2.500 | 2.500 | 2.500 | 2.500 | 2.563 | 2.563 | 2.625 | 2.688 |
| 23.5 | 2.438 | 2.448 | 2.449 | 2.449 | 2.450 | 2.510 | 2.510 | 2.571 | 2.631 |
| 24.0 | 2.375 | 2.397 | 2.398 | 2.398 | 2.399 | 2.457 | 2.458 | 2.516 | 2.575 |
| 24.5 | 2.250 | 2.345 | 2.346 | 2.348 | 2.349 | 2.405 | 2.406 | 2.462 | 2.518 |
| 25.0 | 2.188 | 2.293 | 2.295 | 2.297 | 2.299 | 2.352 | 2.354 | 2.408 | 2.462 |
| 25.5 | 2.125 | 2.242 | 2.244 | 2.246 | 2.248 | 2.300 | 2.302 | 2.354 | 2.405 |
| 26.0 | 2.063 | 2.190 | 2.193 | 2.195 | 2.198 | 2.247 | 2.250 | 2.299 | 2.349 |
| 26.5 | 2.031 | 2.138 | 2.141 | 2.145 | 2.148 | 2.195 | 2.198 | 2.245 | 2.293 |
| 27.0 | 2.000 | 2.087 | 2.090 | 2.094 | 2.097 | 2.142 | 2.146 | 2.191 | 2.236 |
| 27.5 | 2.000 | 2.035 | 2.039 | 2.043 | 2.047 | 2.090 | 2.094 | 2.137 | 2.180 |
| 28.0 | 1.938 | 1.984 | 1.988 | 1.992 | 1.997 | 2.037 | 2.042 | 2.082 | 2.123 |
| 28.5 | 1.938 | 1.932 | 1.937 | 1.941 | 1.946 | 1.985 | 1.990 | 2.028 | 2.067 |
| 29.0 | 1.813 | 1.880 | 1.885 | 1.891 | 1.896 | 1.932 | 1.938 | 1.974 | 2.010 |
| 29.5 | 1.750 | 1.829 | 1.834 | 1.840 | 1.845 | 1.880 | 1.885 | 1.920 | 1.954 |
| 30.0 | 1.688 | 1.777 | 1.783 | 1.789 | 1.795 | 1.827 | 1.833 | 1.865 | 1.898 |
| 30.5 | 1.656 | 1.725 | 1.732 | 1.738 | 1.745 | 1.775 | 1.781 | 1.811 | 1.841 |
| 31.0 | 1.625 | 1.674 | 1.681 | 1.688 | 1.694 | 1.722 | 1.729 | 1.757 | 1.785 |
| 31.5 | 1.500 | 1.622 | 1.629 | 1.637 | 1.644 | 1.670 | 1.677 | 1.703 | 1.728 |

TABLE 1-continued

Top line of each page shows position from center line of tub in inches
Left Column shows distance from head of tub (0.0) to foot of tub (88.0) in inches
Data in table shows height of tub floor at indicated points in inches

| | | | | | | | | | |
|---|---|---|---|---|---|---|---|---|---|
| 32.0 | 1.469 | 1.570 | 1.578 | 1.586 | 1.594 | 1.617 | 1.625 | 1.648 | 1.672 |
| 32.5 | 1.469 | 1.519 | 1.527 | 1.535 | 1.543 | 1.565 | 1.573 | 1.594 | 1.615 |
| 33.0 | 1.438 | 1.467 | 1.476 | 1.484 | 1.493 | 1.512 | 1.521 | 1.540 | 1.559 |
| 33.5 | 1.375 | 1.415 | 1.424 | 1.434 | 1.443 | 1.460 | 1.469 | 1.486 | 1.503 |
| 34.0 | 1.313 | 1.364 | 1.373 | 1.383 | 1.392 | 1.407 | 1.417 | 1.431 | 1.446 |
| 34.5 | 1.281 | 1.312 | 1.322 | 1.332 | 1.342 | 1.355 | 1.365 | 1.377 | 1.390 |
| 35.0 | 1.250 | 1.260 | 1.271 | 1.281 | 1.292 | 1.302 | 1.313 | 1.323 | 1.333 |
| 35.5 | 1.238 | 1.249 | 1.260 | 1.271 | 1.281 | 1.292 | 1.303 | 1.313 | 1.324 |
| 36.0 | 1.227 | 1.238 | 1.249 | 1.260 | 1.271 | 1.282 | 1.293 | 1.304 | 1.315 |
| 36.5 | 1.215 | 1.226 | 1.238 | 1.249 | 1.261 | 1.272 | 1.283 | 1.295 | 1.306 |
| 37.0 | 1.203 | 1.215 | 1.227 | 1.239 | 1.250 | 1.262 | 1.274 | 1.285 | 1.297 |
| 37.5 | 1.192 | 1.204 | 1.216 | 1.228 | 1.240 | 1.252 | 1.264 | 1.276 | 1.288 |
| 38.0 | 1.180 | 1.193 | 1.205 | 1.217 | 1.230 | 1.242 | 1.254 | 1.267 | 1.279 |
| 38.5 | 1.169 | 1.181 | 1.194 | 1.207 | 1.219 | 1.232 | 1.245 | 1.257 | 1.270 |
| 39.0 | 1.157 | 1.170 | 1.183 | 1.196 | 1.209 | 1.222 | 1.235 | 1.248 | 1.261 |
| 39.5 | 1.145 | 1.159 | 1.172 | 1.185 | 1.199 | 1.212 | 1.225 | 1.239 | 1.252 |
| 40.0 | 1.134 | 1.147 | 1.161 | 1.175 | 1.188 | 1.202 | 1.216 | 1.229 | 1.243 |
| 40.5 | 1.122 | 1.136 | 1.150 | 1.164 | 1.178 | 1.192 | 1.206 | 1.220 | 1.234 |
| 41.0 | 1.110 | 1.125 | 1.139 | 1.153 | 1.168 | 1.182 | 1.196 | 1.211 | 1.225 |
| 41.5 | 1.099 | 1.113 | 1.128 | 1.143 | 1.157 | 1.172 | 1.187 | 1.201 | 1.216 |
| 42.0 | 1.087 | 1.102 | 1.117 | 1.132 | 1.147 | 1.162 | 1.177 | 1.192 | 1.207 |
| 42.5 | 1.076 | 1.091 | 1.106 | 1.121 | 1.137 | 1.152 | 1.167 | 1.183 | 1.198 |
| 43.0 | 1.064 | 1.080 | 1.095 | 1.111 | 1.126 | 1.142 | 1.158 | 1.173 | 1.189 |
| 43.5 | 1.052 | 1.068 | 1.084 | 1.100 | 1.116 | 1.132 | 1.148 | 1.164 | 1.180 |
| 44.0 | 1.041 | 1.057 | 1.073 | 1.089 | 1.106 | 1.122 | 1.138 | 1.155 | 1.171 |
| 44.5 | 1.029 | 1.046 | 1.062 | 1.079 | 1.095 | 1.112 | 1.129 | 1.145 | 1.162 |
| 45.0 | 1.017 | 1.034 | 1.051 | 1.068 | 1.085 | 1.102 | 1.119 | 1.136 | 1.153 |
| 45.5 | 1.006 | 1.023 | 1.040 | 1.058 | 1.075 | 1.092 | 1.109 | 1.126 | 1.144 |
| 46.0 | 0.944 | 1.012 | 1.029 | 1.047 | 1.064 | 1.082 | 1.110 | 1.117 | 1.135 |
| 46.5 | 0.983 | 1.000 | 1.018 | 1.036 | 1.054 | 1.072 | 1.090 | 1.108 | 1.126 |
| 47.0 | 0.971 | 0.989 | 1.007 | 1.026 | 1.044 | 1.062 | 1.080 | 1.098 | 1.117 |
| 47.5 | 0.959 | 0.978 | 0.996 | 1.015 | 1.033 | 1.052 | 1.071 | 1.089 | 1.108 |
| 48.0 | 0.948 | 0.967 | 0.985 | 1.004 | 1.023 | 1.042 | 1.061 | 1.080 | 1.099 |
| 48.5 | 0.936 | 0.955 | 0.974 | 0.994 | 1.013 | 1.032 | 1.051 | 1.070 | 1.090 |
| 49.0 | 0.924 | 0.944 | 0.963 | 0.983 | 1.003 | 1.022 | 1.042 | 1.061 | 1.081 |
| 49.5 | 0.913 | 0.933 | 0.952 | 0.972 | 0.992 | 1.012 | 1.032 | 1.052 | 1.072 |
| 50.0 | 0.901 | 0.921 | 0.942 | 0.962 | 0.982 | 1.002 | 1.022 | 1.042 | 1.063 |
| 50.5 | 0.890 | 0.910 | 0.931 | 0.951 | 0.972 | 0.992 | 1.013 | 1.033 | 1.054 |
| 51.0 | 0.878 | 0.899 | 0.920 | 0.940 | 0.961 | 0.982 | 1.003 | 1.024 | 1.045 |
| 51.5 | 0.866 | 0.887 | 0.909 | 0.930 | 0.951 | 0.972 | 0.993 | 1.014 | 1.036 |
| 52.0 | 0.855 | 0.876 | 0.898 | 0.919 | 0.941 | 0.962 | 0.984 | 1.005 | 1.027 |
| 52.5 | 0.843 | 0.865 | 0.887 | 0.908 | 0.930 | 0.952 | 0.974 | 0.996 | 1.018 |
| 53.0 | 0.831 | 0.854 | 0.876 | 0.898 | 0.920 | 0.942 | 0.964 | 0.986 | 1.008 |
| 53.5 | 0.820 | 0.842 | 0.865 | 0.887 | 0.910 | 0.932 | 0.955 | 0.977 | 0.999 |
| 54.0 | 0.808 | 0.831 | 0.854 | 0.877 | 0.899 | 0.922 | 0.945 | 0.968 | 0.990 |
| 54.5 | 0.798 | 0.820 | 0.843 | 0.866 | 0.889 | 0.912 | 0.935 | 0.958 | 0.981 |
| 55.0 | 0.785 | 0.808 | 0.832 | 0.855 | 0.879 | 0.902 | 0.926 | 0.949 | 0.972 |
| 55.5 | 0.773 | 0.797 | 0.821 | 0.845 | 0.868 | 0.892 | 0.916 | 0.940 | 0.963 |
| 56.0 | 0.762 | 0.786 | 0.810 | 0.834 | 0.858 | 0.882 | 0.906 | 0.930 | 0.954 |
| 56.5 | 0.750 | 0.774 | 0.799 | 0.823 | 0.848 | 0.872 | 0.897 | 0.921 | 0.945 |
| 57.0 | 0.738 | 0.763 | 0.788 | 0.813 | 0.837 | 0.862 | 0.887 | 0.912 | 0.936 |
| 57.5 | 0.727 | 0.752 | 0.777 | 0.802 | 0.827 | 0.852 | 0.877 | 0.902 | 0.927 |
| 58.0 | 0.715 | 0.741 | 0.766 | 0.791 | 0.817 | 0.842 | 0.868 | 0.893 | 0.918 |
| 58.5 | 0.703 | 0.729 | 0.755 | 0.781 | 0.806 | 0.832 | 0.858 | 0.884 | 0.909 |
| 59.0 | 0.692 | 0.718 | 0.744 | 0.770 | 0.796 | 0.822 | 0.848 | 0.874 | 0.900 |
| 59.5 | 0.680 | 0.707 | 0.733 | 0.759 | 0.786 | 0.812 | 0.839 | 0.865 | 0.891 |
| 60.0 | 0.669 | 0.695 | 0.722 | 0.749 | 0.775 | 0.802 | 0.829 | 0.856 | 0.882 |
| 60.5 | 0.657 | 0.684 | 0.711 | 0.738 | 0.765 | 0.792 | 0.819 | 0.846 | 0.873 |
| 61.0 | 0.645 | 0.673 | 0.700 | 0.727 | 0.755 | 0.782 | 0.801 | 0.837 | 0.864 |
| 61.5 | 0.634 | 0.661 | 0.689 | 0.717 | 0.744 | 0.772 | 0.800 | 0.828 | 0.855 |
| 62.0 | 0.622 | 0.650 | 0.678 | 0.706 | 0.734 | 0.762 | 0.790 | 0.818 | 0.846 |
| 62.5 | 0.610 | 0.639 | 0.667 | 0.695 | 0.724 | 0.752 | 0.781 | 0.809 | 0.837 |
| 63.0 | 0.599 | 0.628 | 0.656 | 0.685 | 0.714 | 0.742 | 0.771 | 0.800 | 0.828 |
| 63.5 | 0.587 | 0.616 | 0.645 | 0.674 | 0.703 | 0.732 | 0.761 | 0.790 | 0.819 |
| 64.0 | 0.576 | 0.605 | 0.634 | 0.664 | 0.693 | 0.722 | 0.752 | 0.781 | 0.810 |
| 64.5 | 0.564 | 0.594 | 0.623 | 0.653 | 0.683 | 0.712 | 0.742 | 0.771 | 0.801 |
| 65.0 | 0.552 | 0.582 | 0.612 | 0.642 | 0.672 | 0.702 | 0.732 | 0.762 | 0.792 |
| 65.5 | 0.541 | 0.571 | 0.601 | 0.632 | 0.662 | 0.692 | 0.722 | 0.753 | 0.783 |
| 66.0 | 0.529 | 0.560 | 0.590 | 0.621 | 0.652 | 0.682 | 0.713 | 0.743 | 0.774 |
| 66.5 | 0.517 | 0.548 | 0.579 | 0.610 | 0.641 | 0.672 | 0.703 | 0.734 | 0.765 |
| 67.0 | 0.506 | 0.537 | 0.568 | 0.600 | 0.631 | 0.662 | 0.693 | 0.725 | 0.756 |
| 67.5 | 0.494 | 0.526 | 0.557 | 0.589 | 0.621 | 0.652 | 0.684 | 0.715 | 0.747 |
| 68.0 | 0.483 | 0.514 | 0.546 | 0.578 | 0.610 | 0.642 | 0.674 | 0.706 | 0.738 |
| 68.5 | 0.471 | 0.503 | 0.535 | 0.568 | 0.600 | 0.632 | 0.664 | 0.697 | 0.729 |
| 69.0 | 0.459 | 0.492 | 0.524 | 0.557 | 0.590 | 0.622 | 0.655 | 0.687 | 0.720 |

TABLE 1-continued

Top line of each page shows position from center line of tub in inches
Left Column shows distance from head of tub (0.0) to foot of tub (88.0) in inches
Data in table shows height of tub floor at indicated points in inches

| | | | | | | | | | |
|---|---|---|---|---|---|---|---|---|---|
| 69.5 | 0.448 | 0.481 | 0.513 | 0.546 | 0.579 | 0.612 | 0.645 | 0.678 | 0.711 |
| 70.0 | 0.436 | 0.469 | 0.503 | 0.536 | 0.569 | 0.602 | 0.635 | 0.669 | 0.702 |
| 70.5 | 0.424 | 0.458 | 0.492 | 0.525 | 0.559 | 0.592 | 0.626 | 0.659 | 0.693 |
| 71.0 | 0.413 | 0.447 | 0.481 | 0.514 | 0.548 | 0.582 | 0.616 | 0.650 | 0.684 |
| 71.5 | 0.401 | 0.435 | 0.470 | 0.504 | 0.538 | 0.572 | 0.606 | 0.641 | 0.675 |
| 72.0 | 0.390 | 0.424 | 0.459 | 0.493 | 0.528 | 0.562 | 0.597 | 0.631 | 0.666 |
| 72.5 | 0.378 | 0.413 | 0.448 | 0.483 | 0.517 | 0.552 | 0.587 | 0.622 | 0.657 |
| 73.0 | 0.366 | 0.401 | 0.437 | 0.472 | 0.507 | 0.542 | 0.577 | 0.613 | 0.648 |
| 73.5 | 0.355 | 0.390 | 0.426 | 0.461 | 0.497 | 0.532 | 0.568 | 0.603 | 0.639 |
| 74.0 | 0.343 | 0.379 | 0.415 | 0.451 | 0.486 | 0.522 | 0.558 | 0.594 | 0.630 |
| 74.5 | 0.331 | 0.368 | 0.404 | 0.440 | 0.476 | 0.512 | 0.548 | 0.585 | 0.621 |
| 75.0 | 0.320 | 0.356 | 0.393 | 0.429 | 0.466 | 0.502 | 0.539 | 0.575 | 0.612 |
| 75.5 | 0.308 | 0.345 | 0.382 | 0.419 | 0.455 | 0.492 | 0.529 | 0.566 | 0.603 |
| 76.0 | 0.297 | 0.334 | 0.371 | 0.408 | 0.445 | 0.482 | 0.519 | 0.557 | 0.594 |
| 76.5 | 0.285 | 0.322 | 0.360 | 0.397 | 0.435 | 0.472 | 0.510 | 0.547 | 0.585 |
| 77.0 | 0.273 | 0.311 | 0.349 | 0.387 | 0.424 | 0.462 | 0.500 | 0.538 | 0.576 |
| 77.5 | 0.262 | 0.300 | 0.338 | 0.376 | 0.414 | 0.452 | 0.490 | 0.529 | 0.567 |
| 78.0 | 0.250 | 0.288 | 0.327 | 0.365 | 0.404 | 0.442 | 0.481 | 0.519 | 0.558 |
| 78.5 | 0.260 | 0.299 | 0.338 | 0.377 | 0.415 | 0.454 | 0.493 | 0.532 | 0.570 |
| 79.0 | 0.271 | 0.310 | 0.349 | 0.388 | 0.427 | 0.466 | 0.505 | 0.544 | 0.583 |
| 79.5 | 0.281 | 0.321 | 0.360 | 0.399 | 0.439 | 0.478 | 0.517 | 0.557 | 0.596 |
| 80.0 | 0.292 | 0.331 | 0.371 | 0.411 | 0.450 | 0.490 | 0.530 | 0.569 | 0.609 |
| 80.5 | 0.302 | 0.342 | 0.382 | 0.422 | 0.462 | 0.502 | 0.542 | 0.582 | 0.622 |
| 81.0 | 0.313 | 0.353 | 0.393 | 0.433 | 0.474 | 0.514 | 0.554 | 0.594 | 0.634 |
| 81.5 | 0.323 | 0.364 | 0.404 | 0.445 | 0.485 | 0.526 | 0.566 | 0.607 | 0.647 |
| 82.0 | 0.334 | 0.374 | 0.415 | 0.456 | 0.497 | 0.538 | 0.578 | 0.619 | 0.660 |
| 82.5 | 0.344 | 0.385 | 0.426 | 0.467 | 0.508 | 0.550 | 0.591 | 0.632 | 0.673 |
| 83.0 | 0.355 | 0.396 | 0.437 | 0.479 | 0.520 | 0.562 | 0.603 | 0.644 | 0.686 |
| 83.5 | 0.365 | 0.407 | 0.448 | 0.490 | 0.532 | 0.573 | 0.615 | 0.657 | 0.699 |
| 84.0 | 1.365 | 1.407 | 1.448 | 0.490 | 1.532 | 1.573 | 1.615 | 1.657 | 1.698 |
| 84.5 | 16.000 | 16.000 | 16.000 | 16.000 | 16.000 | 16.000 | 16.000 | 16.000 | 16.000 |
| 85.0 | 16.000 | 16.000 | 16.000 | 16.000 | 16.000 | 16.000 | 16.000 | 16.000 | 16.000 |
| 85.5 | 16.000 | 16.000 | 16.000 | 16.000 | 16.000 | 16.000 | 16.000 | 16.000 | 16.000 |
| 86.0 | 16.000 | 16.000 | 16.000 | 16.000 | 16.000 | 16.000 | 16.000 | 16.000 | 16.000 |
| 86.5 | 16.000 | 16.000 | 16.000 | 16.000 | 16.000 | 16.000 | 16.000 | 16.000 | 16.000 |
| 87.0 | 16.000 | 16.000 | 16.000 | 16.000 | 16.000 | 16.000 | 16.000 | 16.000 | 16.000 |
| 87.5 | 16.000 | 16.000 | 16.000 | 16.000 | 16.000 | 16.000 | 16.000 | 16.000 | 16.000 |
| 88.0 | 16.000 | 16.000 | 16.000 | 16.000 | 16.000 | 16.000 | 16.000 | 16.000 | 16.000 |

| | 9.0 | 10.0 | 11.0 | 12.0 | 13.0 | 14.0 | 15.0 | 16.0 | 17.0 |
|---|---|---|---|---|---|---|---|---|---|
| 0.0 | 16.000 | 16.000 | 16.000 | 16.000 | 16.000 | 16.000 | 16.000 | 16.000 | 16.000 |
| 0.5 | 16.000 | 16.000 | 16.000 | 16.000 | 16.000 | 16.000 | 16.000 | 16.000 | 16.000 |
| 1.0 | 16.000 | 16.000 | 16.000 | 16.000 | 16.000 | 16.000 | 16.000 | 16.000 | 16.000 |
| 1.5 | 16.000 | 16.000 | 16.000 | 16.000 | 16.000 | 16.000 | 16.000 | 16.000 | 16.000 |
| 2.0 | 16.000 | 16.000 | 16.000 | 16.000 | 16.000 | 16.000 | 16.000 | 16.000 | 16.000 |
| 2.5 | 16.000 | 16.000 | 16.000 | 16.000 | 16.000 | 16.000 | 16.000 | 16.000 | 16.000 |
| 3.0 | 16.000 | 16.000 | 16.000 | 16.000 | 16.000 | 16.000 | 16.000 | 16.000 | 16.000 |
| 3.5 | 8.000 | 8.000 | 8.000 | 8.000 | 8.000 | 8.000 | 16.000 | 16.000 | 16.000 |
| 4.0 | 7.875 | 7.875 | 7.875 | 7.875 | 7.875 | 7.875 | 16.000 | 16.000 | 16.000 |
| 4.5 | 7.813 | 7.813 | 7.813 | 7.813 | 7.813 | 7.813 | 16.000 | 16.000 | 16.000 |
| 5.0 | 7.813 | 7.813 | 7.813 | 7.813 | 7.813 | 7.813 | 16.000 | 16.000 | 16.000 |
| 5.5 | 7.813 | 7.813 | 7.813 | 7.813 | 7.813 | 7.813 | 16.000 | 16.000 | 16.000 |
| 6.0 | 7.813 | 7.813 | 7.813 | 7.813 | 7.813 | 7.813 | 16.000 | 16.000 | 16.000 |
| 6.5 | 7.813 | 7.813 | 7.813 | 7.813 | 7.813 | 7.813 | 16.000 | 16.000 | 16.000 |
| 7.0 | 7.813 | 7.813 | 7.813 | 7.813 | 7.813 | 7.813 | 16.000 | 16.000 | 16.000 |
| 7.5 | 7.813 | 7.813 | 7.813 | 7.813 | 7.813 | 7.813 | 16.000 | 16.000 | 16.000 |
| 8.0 | 7.813 | 7.813 | 7.813 | 7.813 | 7.813 | 7.813 | 16.000 | 16.000 | 16.000 |
| 8.5 | 7.813 | 7.813 | 7.813 | 7.813 | 7.813 | 7.813 | 16.000 | 16.000 | 16.000 |
| 9.0 | 7.813 | 7.813 | 7.813 | 7.813 | 7.813 | 7.813 | 16.000 | 16.000 | 16.000 |
| 9.5 | 7.563 | 7.875 | 7.813 | 7.813 | 7.813 | 7.813 | 16.000 | 16.000 | 16.000 |
| 10.0 | 7.188 | 7.250 | 7.438 | 7.563 | 7.719 | 7.813 | 16.000 | 16.000 | 16.000 |
| 10.5 | 6.063 | 6.125 | 6.375 | 6.500 | 6.563 | 6.875 | 16.000 | 16.000 | 16.000 |
| 11.0 | 4.938 | 5.000 | 5.250 | 5.438 | 5.500 | 5.625 | 16.000 | 16.000 | 16.000 |
| 11.5 | 4.250 | 4.313 | 4.313 | 4.344 | 4.438 | 4.719 | 16.000 | 16.000 | 16.000 |
| 12.0 | 4.250 | 4.188 | 4.125 | 4.188 | 4.156 | 4.219 | 16.000 | 16.000 | 16.000 |
| 12.5 | 4.875 | 4.375 | 4.188 | 4.125 | 4.063 | 4.094 | 16.000 | 16.000 | 16.000 |
| 13.0 | 6.313 | 5.313 | 4.438 | 4.063 | 4.031 | 4.001 | 16.000 | 16.000 | 16.000 |
| 13.5 | 7.000 | 6.250 | 5.125 | 4.063 | 4.031 | 3.948 | 16.000 | 16.000 | 16.000 |
| 14.0 | 7.375 | 6.813 | 5.563 | 4.125 | 3.975 | 3.894 | 16.000 | 16.000 | 16.000 |
| 14.5 | 7.500 | 6.875 | 5.813 | 4.313 | 3.920 | 3.841 | 16.000 | 16.000 | 16.000 |
| 15.0 | 7.438 | 6.781 | 5.750 | 4.500 | 3.864 | 3.787 | 16.000 | 16.000 | 16.000 |
| 15.5 | 7.125 | 6.344 | 5.500 | 4.594 | 3.808 | 3.734 | 16.000 | 16.000 | 16.000 |
| 16.0 | 6.625 | 6.044 | 5.344 | 4.625 | 3.752 | 3.680 | 16.000 | 16.000 | 16.000 |
| 16.5 | 6.125 | 5.696 | 5.125 | 4.531 | 3.696 | 3.627 | 16.000 | 16.000 | 16.000 |

TABLE 1-continued

Top line of each page shows position from center line of tub in inches
Left Column shows distance from head of tub (0.0) to foot of tub (88.0) in inches
Data in table shows height of tub floor at indicated points in inches

| | | | | | | | | | |
|---|---|---|---|---|---|---|---|---|---|
| 17.0 | 5.625 | 5.348 | 4.893 | 4.438 | 3.640 | 3.573 | 16.000 | 16.000 | 16.000 |
| 17.5 | 5.188 | 5.000 | 4.688 | 4.375 | 3.584 | 3.520 | 16.000 | 16.000 | 16.000 |
| 18.0 | 4.813 | 4.750 | 4.520 | 4.290 | 3.528 | 3.466 | 16.000 | 16.000 | 16.000 |
| 18.5 | 4.500 | 4.500 | 4.344 | 4.188 | 3.473 | 3.413 | 16.000 | 16.000 | 16.000 |
| 19.0 | 4.188 | 4.313 | 4.250 | 4.063 | 3.417 | 3.359 | 16.000 | 16.000 | 16.000 |
| 19.5 | 3.938 | 4.125 | 4.063 | 4.000 | 3.361 | 3.306 | 16.000 | 16.000 | 16.000 |
| 20.0 | 3.750 | 3.875 | 3.938 | 3.875 | 3.305 | 3.252 | 16.000 | 16.000 | 16.000 |
| 20.5 | 3.563 | 3.719 | 3.688 | 3.750 | 3.249 | 3.199 | 16.000 | 16.000 | 16.000 |
| 21.0 | 3.375 | 3.500 | 3.625 | 3.625 | 3.193 | 3.145 | 16.000 | 16.000 | 16.000 |
| 21.5 | 3.188 | 3.250 | 3.500 | 3.500 | 3.137 | 3.092 | 16.000 | 16.000 | 16.000 |
| 22.0 | 3.063 | 3.188 | 3.313 | 3.375 | 3.081 | 3.038 | 16.000 | 16.000 | 16.000 |
| 22.5 | 2.875 | 3.125 | 3.188 | 3.313 | 3.026 | 3.985 | 16.000 | 16.000 | 16.000 |
| 23.0 | 2.813 | 3.000 | 3.063 | 3.219 | 2.970 | 2.931 | 16.000 | 16.000 | 16.000 |
| 23.5 | 2.751 | 2.931 | 3.000 | 3.125 | 2.914 | 2.878 | 16.000 | 16.000 | 16.000 |
| 24.0 | 2.690 | 2.863 | 2.875 | 2.969 | 2.858 | 2.824 | 16.000 | 16.000 | 16.000 |
| 24.5 | 2.629 | 2.794 | 2.880 | 2.938 | 2.802 | 2.771 | 16.000 | 16.000 | 16.000 |
| 25.0 | 2.568 | 2.726 | 2.760 | 2.813 | 2.746 | 2.717 | 16.000 | 16.000 | 16.000 |
| 25.5 | 2.507 | 2.657 | 2.669 | 2.719 | 2.690 | 2.664 | 16.000 | 16.000 | 16.000 |
| 26.0 | 2.445 | 2.589 | 2.635 | 2.688 | 2.634 | 2.610 | 16.000 | 16.000 | 16.000 |
| 26.5 | 2.384 | 2.520 | 2.568 | 2.617 | 2.579 | 2.557 | 16.000 | 16.000 | 16.000 |
| 27.0 | 2.323 | 2.451 | 2.501 | 2.547 | 2.523 | 2.503 | 16.000 | 16.000 | 16.000 |
| 27.5 | 2.262 | 2.383 | 2.437 | 2.477 | 2.467 | 2.496 | 16.000 | 16.000 | 16.000 |
| 28.0 | 2.201 | 2.314 | 2.367 | 2.406 | 2.411 | 2.488 | 16.000 | 16.000 | 16.000 |
| 28.5 | 2.139 | 2.246 | 2.303 | 2.336 | 2.355 | 2.481 | 16.000 | 16.000 | 16.000 |
| 29.0 | 2.078 | 2.177 | 2.228 | 2.266 | 2.299 | 2.474 | 16.000 | 16.000 | 16.000 |
| 29.5 | 2.017 | 2.109 | 2.158 | 2.195 | 2.243 | 2.466 | 16.000 | 16.000 | 16.000 |
| 30.0 | 1.956 | 2.040 | 2.089 | 2.125 | 2.188 | 2.459 | 16.000 | 16.000 | 16.000 |
| 30.5 | 1.895 | 1.971 | 2.021 | 2.055 | 2.128 | 2.451 | 16.000 | 16.000 | 16.000 |
| 31.0 | 1.833 | 1.903 | 1.954 | 1.984 | 2.069 | 2.444 | 16.000 | 16.000 | 16.000 |
| 31.5 | 1.772 | 1.834 | 1.880 | 1.914 | 2.009 | 2.437 | 16.000 | 16.000 | 16.000 |
| 32.0 | 1.711 | 1.766 | 1.813 | 1.844 | 1.950 | 2.429 | 16.000 | 16.000 | 16.000 |
| 32.5 | 1.650 | 1.697 | 1.727 | 1.750 | 1.813 | 2.422 | 16.000 | 16.000 | 16.000 |
| 33.0 | 1.589 | 1.628 | 1.638 | 1.656 | 1.727 | 2.415 | 16.000 | 16.000 | 16.000 |
| 33.5 | 1.527 | 1.560 | 1.576 | 1.594 | 1.642 | 2.407 | 16.000 | 16.000 | 16.000 |
| 34.0 | 1.466 | 1.491 | 1.484 | 1.500 | 1.556 | 2.400 | 16.000 | 16.000 | 16.000 |
| 34.5 | 1.405 | 1.423 | 1.424 | 1.438 | 1.471 | 2.392 | 16.000 | 16.000 | 16.000 |
| 35.0 | 1.344 | 1.354 | 1.365 | 1.375 | 1.385 | 2.385 | 16.000 | 16.000 | 16.000 |
| 35.5 | 1.335 | 1.345 | 1.356 | 1.367 | 1.378 | 2.378 | 16.000 | 16.000 | 16.000 |
| 36.0 | 1.326 | 1.337 | 1.348 | 1.359 | 1.370 | 2.370 | 16.000 | 16.000 | 16.000 |
| 36.5 | 1.317 | 1.329 | 1.340 | 1.351 | 1.363 | 2.363 | 16.000 | 16.000 | 16.000 |
| 37.0 | 1.309 | 1.320 | 1.332 | 1.344 | 1.355 | 2.355 | 16.000 | 16.000 | 16.000 |
| 37.5 | 1.300 | 1.312 | 1.324 | 1.336 | 1.348 | 2.348 | 16.000 | 16.000 | 16.000 |
| 38.0 | 1.291 | 1.304 | 1.316 | 1.328 | 1.341 | 2.341 | 16.000 | 16.000 | 16.000 |
| 38.5 | 1.283 | 1.295 | 1.308 | 1.321 | 1.333 | 2.333 | 16.000 | 16.000 | 16.000 |
| 39.0 | 1.274 | 1.287 | 1.300 | 1.313 | 1.326 | 2.326 | 16.000 | 16.000 | 16.000 |
| 39.5 | 1.265 | 1.279 | 1.292 | 1.305 | 1.319 | 2.319 | 16.000 | 16.000 | 16.000 |
| 40.0 | 1.257 | 1.270 | 1.284 | 1.298 | 1.311 | 2.311 | 16.000 | 16.000 | 16.000 |
| 40.5 | 1.248 | 1.262 | 1.276 | 1.290 | 1.304 | 2.304 | 16.000 | 16.000 | 16.000 |
| 41.0 | 1.239 | 1.253 | 1.268 | 1.282 | 1.296 | 2.296 | 16.000 | 16.000 | 16.000 |
| 41.5 | 1.230 | 1.245 | 1.260 | 1.274 | 1.289 | 2.289 | 16.000 | 16.000 | 16.000 |
| 42.0 | 1.222 | 1.237 | 1.252 | 1.267 | 1.282 | 2.282 | 16.000 | 16.000 | 16.000 |
| 42.5 | 1.213 | 1.228 | 1.244 | 1.259 | 1.274 | 2.274 | 16.000 | 16.000 | 16.000 |
| 43.0 | 1.204 | 1.220 | 1.236 | 1.251 | 1.267 | 2.267 | 16.000 | 16.000 | 16.000 |
| 43.5 | 1.196 | 1.212 | 1.228 | 1.244 | 1.259 | 2.259 | 16.000 | 16.000 | 16.000 |
| 44.0 | 1.187 | 1.203 | 1.220 | 1.236 | 1.252 | 2.252 | 16.000 | 16.000 | 16.000 |
| 44.5 | 1.178 | 1.195 | 1.212 | 1.228 | 1.245 | 2.245 | 16.000 | 16.000 | 16.000 |
| 45.0 | 1.170 | 1.187 | 1.203 | 1.220 | 1.237 | 2.237 | 16.000 | 16.000 | 16.000 |
| 45.5 | 1.161 | 1.178 | 1.195 | 1.213 | 1.230 | 2.230 | 16.000 | 16.000 | 16.000 |
| 46.0 | 1.152 | 1.170 | 1.187 | 1.205 | 1.223 | 2.223 | 16.000 | 16.000 | 16.000 |
| 46.5 | 1.144 | 1.161 | 1.179 | 1.197 | 1.215 | 2.215 | 16.000 | 16.000 | 16.000 |
| 47.0 | 1.135 | 1.153 | 1.171 | 1.190 | 1.208 | 2.208 | 16.000 | 16.000 | 16.000 |
| 47.5 | 1.126 | 1.145 | 1.163 | 1.182 | 1.200 | 2.200 | 16.000 | 16.000 | 16.000 |
| 48.0 | 1.118 | 1.136 | 1.155 | 1.174 | 1.193 | 2.193 | 16.000 | 16.000 | 16.000 |
| 48.5 | 1.109 | 1.128 | 1.147 | 1.166 | 1.186 | 2.186 | 16.000 | 16.000 | 16.000 |
| 49.0 | 1.100 | 1.120 | 1.139 | 1.159 | 1.178 | 2.178 | 16.000 | 16.000 | 16.000 |
| 49.5 | 1.091 | 1.111 | 1.131 | 1.151 | 1.171 | 2.171 | 16.000 | 16.000 | 16.000 |
| 50.0 | 1.083 | 1.103 | 1.123 | 1.143 | 1.163 | 2.163 | 16.000 | 16.000 | 16.000 |
| 50.5 | 1.074 | 1.095 | 1.115 | 1.136 | 1.156 | 2.156 | 16.000 | 16.000 | 16.000 |
| 51.0 | 1.065 | 1.086 | 1.107 | 1.128 | 1.149 | 2.149 | 16.000 | 16.000 | 16.000 |
| 51.5 | 1.057 | 1.078 | 1.099 | 1.120 | 1.141 | 2.141 | 16.000 | 16.000 | 16.000 |
| 52.0 | 1.048 | 1.069 | 1.091 | 1.112 | 1.134 | 2.134 | 16.000 | 16.000 | 16.000 |
| 52.5 | 1.039 | 1.061 | 1.083 | 1.105 | 1.127 | 2.127 | 16.000 | 16.000 | 16.000 |
| 53.0 | 1.031 | 1.053 | 1.075 | 1.097 | 1.119 | 2.119 | 16.000 | 16.000 | 16.000 |
| 53.5 | 1.022 | 1.044 | 1.067 | 1.089 | 1.112 | 2.112 | 16.000 | 16.000 | 16.000 |
| 54.0 | 1.013 | 1.036 | 1.059 | 1.082 | 1.104 | 2.104 | 16.000 | 16.000 | 16.000 |

TABLE 1-continued

Top line of each page shows position from center line of tub in inches
Left Column shows distance from head of tub (0.0) to foot of tub (88.0) in inches
Data in table shows height of tub floor at indicated points in inches

| | | | | | | | | | |
|---|---|---|---|---|---|---|---|---|---|
| 54.5 | 1.005 | 1.028 | 1.051 | 1.074 | 1.097 | 2.097 | 16.000 | 16.000 | 16.000 |
| 55.0 | 0.996 | 1.019 | 1.043 | 1.066 | 1.090 | 2.090 | 16.000 | 16.000 | 16.000 |
| 55.5 | 0.987 | 1.011 | 1.035 | 1.058 | 1.082 | 2.082 | 16.000 | 16.000 | 16.000 |
| 56.0 | 0.978 | 1.003 | 1.027 | 1.051 | 1.075 | 2.075 | 16.000 | 16.000 | 16.000 |
| 56.5 | 0.970 | 0.994 | 1.019 | 1.043 | 1.068 | 2.068 | 16.000 | 16.000 | 16.000 |
| 57.0 | 0.961 | 0.986 | 1.011 | 1.035 | 1.060 | 2.060 | 16.000 | 16.000 | 16.000 |
| 57.5 | 0.952 | 0.978 | 1.003 | 1.028 | 1.053 | 2.053 | 16.000 | 16.000 | 16.000 |
| 58.0 | 0.944 | 0.969 | 0.995 | 1.020 | 1.045 | 2.045 | 16.000 | 16.000 | 16.000 |
| 58.5 | 0.935 | 0.961 | 0.987 | 1.012 | 1.038 | 2.038 | 16.000 | 16.000 | 16.000 |
| 59.0 | 0.926 | 0.952 | 0.978 | 1.005 | 1.031 | 2.031 | 16.000 | 16.000 | 16.000 |
| 59.5 | 0.918 | 0.944 | 0.970 | 0.997 | 1.023 | 2.023 | 16.000 | 16.000 | 16.000 |
| 60.0 | 0.909 | 0.936 | 0.962 | 0.989 | 1.016 | 2.016 | 16.000 | 16.000 | 16.000 |
| 60.5 | 0.900 | 0.927 | 0.954 | 0.981 | 1.008 | 2.008 | 16.000 | 16.000 | 16.000 |
| 61.0 | 0.892 | 0.919 | 0.946 | 0.974 | 1.001 | 2.001 | 16.000 | 16.000 | 16.000 |
| 61.5 | 0.883 | 0.911 | 0.938 | 0.966 | 0.994 | 1.994 | 16.000 | 16.000 | 16.000 |
| 62.0 | 0.874 | 0.902 | 0.930 | 0.958 | 0.986 | 1.986 | 16.000 | 16.000 | 16.000 |
| 62.5 | 0.866 | 0.894 | 0.922 | 0.951 | 0.979 | 1.979 | 16.000 | 16.000 | 16.000 |
| 63.0 | 0.857 | 0.886 | 0.914 | 0.943 | 0.972 | 1.972 | 16.000 | 16.000 | 16.000 |
| 63.5 | 0.848 | 0.877 | 0.906 | 0.935 | 0.964 | 1.964 | 16.000 | 16.000 | 16.000 |
| 64.0 | 0.839 | 0.869 | 0.898 | 0.927 | 0.957 | 1.957 | 16.000 | 16.000 | 16.000 |
| 64.5 | 0.831 | 0.860 | 0.890 | 0.920 | 0.949 | 1.949 | 16.000 | 16.000 | 16.000 |
| 65.0 | 0.822 | 0.852 | 0.882 | 0.912 | 0.942 | 1.942 | 16.000 | 16.000 | 16.000 |
| 65.5 | 0.813 | 0.844 | 0.874 | 0.904 | 0.935 | 1.935 | 16.000 | 16.000 | 16.000 |
| 66.0 | 0.805 | 0.835 | 0.866 | 0.897 | 0.927 | 1.927 | 16.000 | 16.000 | 16.000 |
| 66.5 | 0.796 | 0.827 | 0.858 | 0.889 | 0.920 | 1.920 | 16.000 | 16.000 | 16.000 |
| 67.0 | 0.787 | 0.819 | 0.850 | 0.881 | 0.912 | 1.912 | 16.000 | 16.000 | 16.000 |
| 67.5 | 0.779 | 0.810 | 0.842 | 0.873 | 0.905 | 1.905 | 16.000 | 16.000 | 16.000 |
| 68.0 | 0.770 | 0.802 | 0.834 | 0.866 | 0.898 | 1.898 | 16.000 | 16.000 | 16.000 |
| 68.5 | 0.761 | 0.794 | 0.826 | 0.858 | 0.890 | 1.890 | 16.000 | 16.000 | 16.000 |
| 69.0 | 0.753 | 0.785 | 0.818 | 0.850 | 0.883 | 1.883 | 16.000 | 16.000 | 16.000 |
| 69.5 | 0.744 | 0.777 | 0.810 | 0.843 | 0.876 | 1.876 | 16.000 | 16.000 | 16.000 |
| 70.0 | 0.735 | 0.768 | 0.802 | 0.835 | 0.868 | 1.868 | 16.000 | 16.000 | 16.000 |
| 70.5 | 0.726 | 0.760 | 0.794 | 0.827 | 0.861 | 1.861 | 16.000 | 16.000 | 16.000 |
| 71.0 | 0.718 | 0.752 | 0.786 | 0.819 | 0.853 | 1.853 | 16.000 | 16.000 | 16.000 |
| 71.5 | 0.709 | 0.743 | 0.778 | 0.812 | 0.846 | 1.846 | 16.000 | 16.000 | 16.000 |
| 72.0 | 0.700 | 0.735 | 0.770 | 0.804 | 0.839 | 1.839 | 16.000 | 16.000 | 16.000 |
| 72.5 | 0.692 | 0.727 | 0.761 | 0.796 | 0.831 | 1.831 | 16.000 | 16.000 | 16.000 |
| 73.0 | 0.683 | 0.718 | 0.753 | 0.789 | 0.824 | 1.824 | 16.000 | 16.000 | 16.000 |
| 73.5 | 0.674 | 0.710 | 0.745 | 0.781 | 0.816 | 1.816 | 16.000 | 16.000 | 16.000 |
| 74.0 | 0.666 | 0.702 | 0.737 | 0.773 | 0.809 | 1.809 | 16.000 | 16.000 | 16.000 |
| 74.5 | 0.657 | 0.693 | 0.729 | 0.766 | 0.802 | 1.802 | 16.000 | 16.000 | 16.000 |
| 75.0 | 0.648 | 0.685 | 0.721 | 0.758 | 0.794 | 1.794 | 16.000 | 16.000 | 16.000 |
| 75.5 | 0.640 | 0.676 | 0.713 | 0.750 | 0.787 | 1.787 | 16.000 | 16.000 | 16.000 |
| 76.0 | 0.631 | 0.668 | 0.705 | 0.742 | 0.780 | 1.780 | 16.000 | 16.000 | 16.000 |
| 76.5 | 0.622 | 0.660 | 0.697 | 0.735 | 0.772 | 1.772 | 16.000 | 16.000 | 16.000 |
| 77.0 | 0.614 | 0.651 | 0.689 | 0.727 | 0.765 | 1.765 | 16.000 | 16.000 | 16.000 |
| 77.5 | 0.605 | 0.643 | 0.681 | 0.719 | 0.757 | 1.757 | 16.000 | 16.000 | 16.000 |
| 78.0 | 0.596 | 0.635 | 0.673 | 0.712 | 0.750 | 1.750 | 16.000 | 16.000 | 16.000 |
| 78.5 | 0.609 | 0.648 | 0.687 | 0.726 | 0.764 | 1.750 | 16.000 | 16.000 | 16.000 |
| 79.0 | 0.622 | 0.661 | 0.700 | 0.739 | 0.779 | 1.766 | 16.000 | 16.000 | 16.000 |
| 79.5 | 0.635 | 0.675 | 0.714 | 0.753 | 0.793 | 1.781 | 16.000 | 16.000 | 16.000 |
| 80.0 | 0.649 | 0.688 | 0.728 | 0.767 | 0.807 | 1.797 | 16.000 | 16.000 | 16.000 |
| 80.5 | 0.662 | 0.702 | 0.741 | 0.781 | 0.821 | 1.813 | 16.000 | 16.000 | 16.000 |
| 81.0 | 0.675 | 0.715 | 0.755 | 0.795 | 0.836 | 1.828 | 16.000 | 16.000 | 16.000 |
| 81.5 | 0.688 | 0.728 | 0.769 | 0.809 | 0.850 | 1.844 | 16.000 | 16.000 | 16.000 |
| 82.0 | 0.701 | 0.742 | 0.783 | 0.823 | 0.864 | 1.860 | 16.000 | 16.000 | 16.000 |
| 82.5 | 0.714 | 0.755 | 0.796 | 0.837 | 0.878 | 1.875 | 16.000 | 16.000 | 16.000 |
| 83.0 | 0.727 | 0.768 | 0.810 | 0.851 | 0.893 | 1.891 | 16.000 | 16.000 | 16.000 |
| 83.5 | 0.740 | 0.782 | 0.824 | 0.865 | 0.907 | 1.907 | 16.000 | 16.000 | 16.000 |
| 84.0 | 1.740 | 1.782 | 1.823 | 1.865 | 1.907 | 1.907 | 16.000 | 16.000 | 16.000 |
| 84.5 | 16.000 | 16.000 | 16.000 | 16.000 | 16.000 | 16.000 | 16.000 | 16.000 | 16.000 |
| 85.0 | 16.000 | 16.000 | 16.000 | 16.000 | 16.000 | 16.000 | 16.000 | 16.000 | 16.000 |
| 85.5 | 16.000 | 16.000 | 16.000 | 16.000 | 16.000 | 16.000 | 16.000 | 16.000 | 16.000 |
| 86.0 | 16.000 | 16.000 | 16.000 | 16.000 | 16.000 | 16.000 | 16.000 | 16.000 | 16.000 |
| 86.5 | 16.000 | 16.000 | 16.000 | 16.000 | 16.000 | 16.000 | 16.000 | 16.000 | 16.000 |
| 87.0 | 16.000 | 16.000 | 16.000 | 16.000 | 16.000 | 16.000 | 16.000 | 16.000 | 16.000 |
| 87.5 | 16.000 | 16.000 | 16.000 | 16.000 | 16.000 | 16.000 | 16.000 | 16.000 | 16.000 |
| 88.0 | 16.000 | 16.000 | 16.000 | 16.000 | 16.000 | 16.000 | 16.000 | 16.000 | 16.000 |

| | 18.0 |
|---|---|
| 0.0 | 16.000 |
| 0.5 | 16.000 |
| 1.0 | 16.000 |
| 1.5 | 16.000 |

TABLE 1-continued

Top line of each page shows position from center line of tub in inches
Left Column shows distance from head of tub (0.0) to foot of tub (88.0) in inches
Data in table shows height of tub floor at indicated points in inches

| | |
|---|---|
| 2.0 | 16.000 |
| 2.5 | 16.000 |
| 3.0 | 16.000 |
| 3.5 | 16.000 |
| 4.0 | 16.000 |
| 4.5 | 16.000 |
| 5.0 | 16.000 |
| 5.5 | 16.000 |
| 6.0 | 16.000 |
| 6.5 | 16.000 |
| 7.0 | 16.000 |
| 7.5 | 16.000 |
| 8.0 | 16.000 |
| 8.5 | 16.000 |
| 9.0 | 16.000 |
| 9.5 | 16.000 |
| 10.0 | 16.000 |
| 10.5 | 16.000 |
| 11.0 | 16.000 |
| 11.5 | 16.000 |
| 12.0 | 16.000 |
| 12.5 | 16.000 |
| 13.0 | 16.000 |
| 13.5 | 16.000 |
| 14.0 | 16.000 |
| 14.5 | 16.000 |
| 15.0 | 16.000 |
| 15.5 | 16.000 |
| 16.0 | 16.000 |
| 16.5 | 16.000 |
| 17.0 | 16.000 |
| 17.5 | 16.000 |
| 18.0 | 16.000 |
| 18.5 | 16.000 |
| 19.0 | 16.000 |
| 19.5 | 16.000 |
| 20.0 | 16.000 |
| 20.5 | 16.000 |
| 21.0 | 16.000 |
| 21.5 | 16.000 |
| 22.0 | 16.000 |
| 22.5 | 16.000 |
| 23.0 | 16.000 |
| 23.5 | 16.000 |
| 24.0 | 16.000 |
| 24.5 | 16.000 |
| 25.0 | 16.000 |
| 25.5 | 16.000 |
| 26.0 | 16.000 |
| 26.5 | 16.000 |
| 27.0 | 16.000 |
| 27.5 | 16.000 |
| 28.0 | 16.000 |
| 28.5 | 16.000 |
| 29.0 | 16.000 |
| 29.5 | 16.000 |
| 30.0 | 16.000 |
| 30.5 | 16.000 |
| 31.0 | 16.000 |
| 31.5 | 16.000 |
| 32.0 | 16.000 |
| 32.5 | 16.000 |
| 33.0 | 16.000 |
| 33.5 | 16.000 |
| 34.0 | 16.000 |
| 34.5 | 16.000 |
| 35.0 | 16.000 |
| 35.5 | 16.000 |
| 36.0 | 16.000 |
| 36.5 | 16.000 |
| 37.0 | 16.000 |
| 37.5 | 16.000 |
| 38.0 | 16.000 |
| 38.5 | 16.000 |
| 39.0 | 16.000 |

TABLE 1-continued

Top line of each page shows position from center line of tub in inches
Left Column shows distance from head of tub (0.0) to foot of tub (88.0) in inches
Data in table shows height of tub floor at indicated points in inches

| | |
|---|---|
| 39.5 | 16.000 |
| 40.0 | 16.000 |
| 40.5 | 16.000 |
| 41.0 | 16.000 |
| 41.5 | 16.000 |
| 42.0 | 16.000 |
| 42.5 | 16.000 |
| 43.0 | 16.000 |
| 43.5 | 16.000 |
| 44.0 | 16.000 |
| 44.5 | 16.000 |
| 45.0 | 16.000 |
| 45.5 | 16.000 |
| 46.0 | 16.000 |
| 46.5 | 16.000 |
| 47.0 | 16.000 |
| 47.5 | 16.000 |
| 48.0 | 16.000 |
| 48.5 | 16.000 |
| 49.0 | 16.000 |
| 49.5 | 16.000 |
| 50.0 | 16.000 |
| 50.5 | 16.000 |
| 51.0 | 16.000 |
| 51.5 | 16.000 |
| 52.0 | 16.000 |
| 52.5 | 16.000 |
| 53.0 | 16.000 |
| 53.5 | 16.000 |
| 54.0 | 16.000 |
| 54.5 | 16.000 |
| 55.0 | 16.000 |
| 55.5 | 16.000 |
| 56.0 | 16.000 |
| 56.5 | 16.000 |
| 57.0 | 16.000 |
| 57.5 | 16.000 |
| 58.0 | 16.000 |
| 58.5 | 16.000 |
| 59.0 | 16.000 |
| 59.5 | 16.000 |
| 60.0 | 16.000 |
| 60.5 | 16.000 |
| 61.0 | 16.000 |
| 61.5 | 16.000 |
| 62.0 | 16.000 |
| 62.5 | 16.000 |
| 63.0 | 16.000 |
| 63.5 | 16.000 |
| 64.0 | 16.000 |
| 64.5 | 16.000 |
| 65.0 | 16.000 |
| 65.5 | 16.000 |
| 66.0 | 16.000 |
| 66.5 | 16.000 |
| 67.0 | 16.000 |
| 67.5 | 16.000 |
| 68.0 | 16.000 |
| 68.5 | 16.000 |
| 69.0 | 16.000 |
| 69.5 | 16.000 |
| 70.0 | 16.000 |
| 70.5 | 16.000 |
| 71.0 | 16.000 |
| 71.5 | 16.000 |
| 72.0 | 16.000 |
| 72.5 | 16.000 |
| 73.0 | 16.000 |
| 73.5 | 16.000 |
| 74.0 | 16.000 |
| 74.5 | 16.000 |
| 75.0 | 16.000 |
| 75.5 | 16.000 |
| 76.0 | 16.000 |
| 76.5 | 16.000 |

TABLE 1-continued

| Top line of each page shows position from center line of tub in inches<br>Left Column shows distance from head of tub (0.0) to foot of tub (88.0) in inches<br>Data in table shows height of tub floor at indicated points in inches | |
|---|---|
| 77.0 | 16.000 |
| 77.5 | 16.000 |
| 78.0 | 16.000 |
| 78.5 | 16.000 |
| 79.0 | 16.000 |
| 79.5 | 16.000 |
| 80.0 | 16.000 |
| 80.5 | 16.000 |
| 81.0 | 16.000 |
| 81.5 | 16.000 |
| 82.0 | 16.000 |
| 82.5 | 16.000 |
| 83.0 | 16.000 |
| 83.5 | 16.000 |
| 84.0 | 16.000 |
| 84.5 | 16.000 |
| 85.0 | 16.000 |
| 85.5 | 16.000 |
| 86.0 | 16.000 |
| 86.5 | 16.000 |
| 87.0 | 16.000 |
| 87.5 | 16.000 |
| 88.0 | 16.000 |

Figure 7:
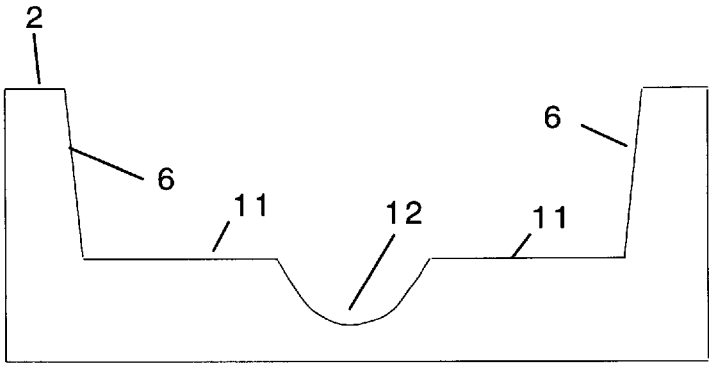
FIG. 7 is a cross-sectional detail view of the first embodiment taken at station 7.5 inches, showing the head bowl.
Figure 8:
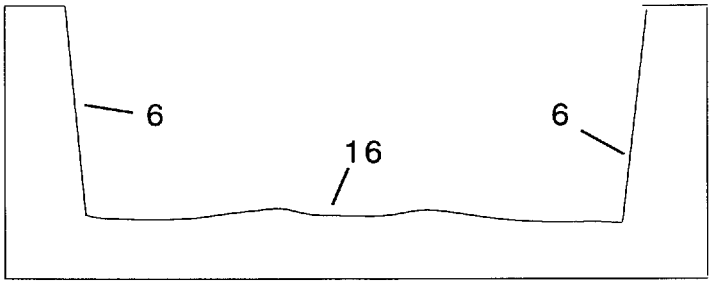
FIG. 8 is a cross-sectional detail view of the first embodiment taken at station 12 inches, showing the beginning of the neck support.
Figure 9:
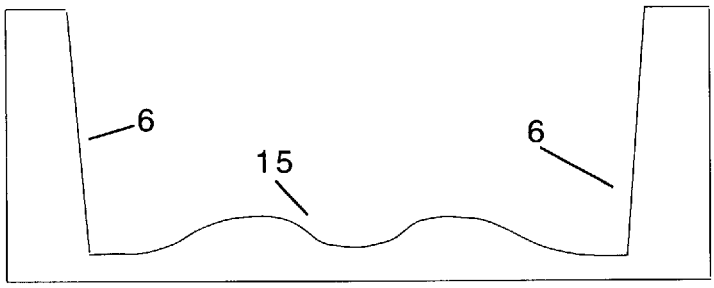
FIG. 9 is a cross-sectional detail view of the first embodiment taken at station 12.5 inches, showing the curvature of the neck support at this point in the tub.
Figure 10:
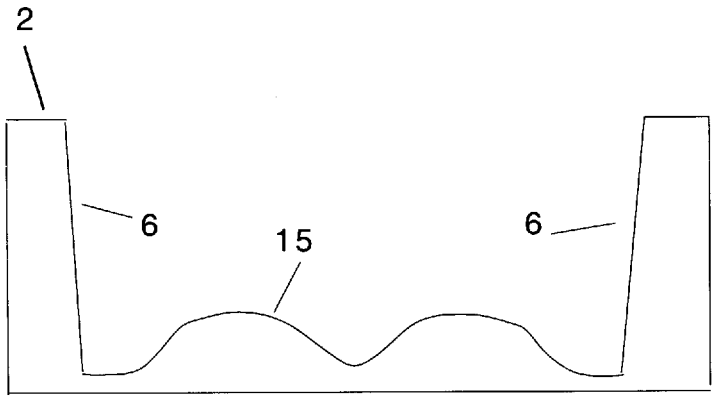
FIG. 10 is a cross-sectional detail view of the first embodiment taken at station 13 inches, showing the curvature of the neck support at this point in the tub.
Figure 11:
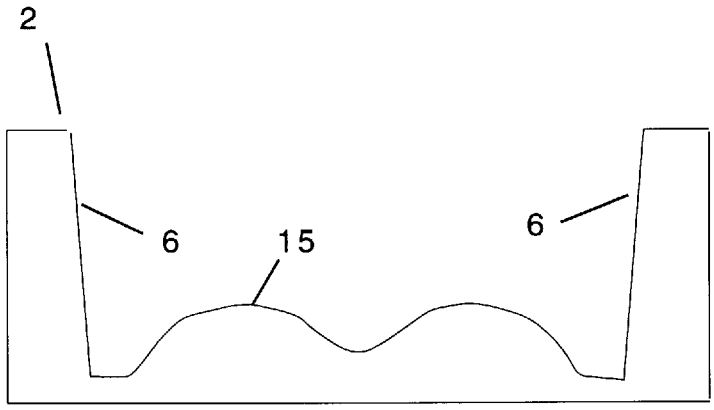
FIG. 11 is a cross-sectional detail view of the first embodiment taken at station 13.5 inches, showing the curvature of the neck support at this point in the tub.

FIG. 7 is a graphical representation of the cross-section described at 7.5 inches from the head of the tub. This section shows the lower edge of the head bowl 12 and the shelf 11. FIGS. 8–11 are graphical representations of the neck support 15 taken at the positions indicated.

Figure 3:
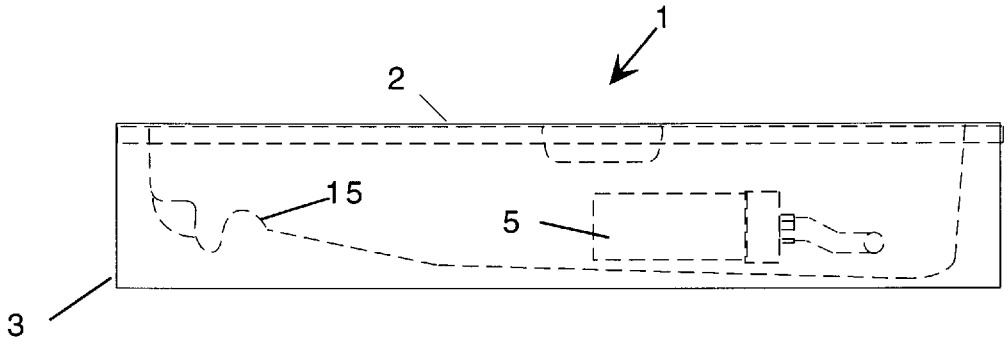
FIG. 3 is a side view of the tub with the enclosure wall in place.

FIGS. 3 and 14 show that the neck support 15 slopes from the peak of the support down toward the foot of the tub 1. This slope provides proper back support and is designed to keep the vertebrae in proper alignment while reclining in the tub 1. This system allows a user to fully stretch out and relax the back and legs while ensuring that the user is protected from slipping under the water and drowning. Moreover, as discussed above the combination of the head support 10 and neck support 15 works to maintain a comfortable position that does not cause neck stiffness. This is the key advantage of this design over the prior art discussed above. All of those designs had some type of head support. However, none of them have a head support 10 and neck support 15 that cradles the head and neck in the proper position to eliminate stiffness in the neck over time.

As discussed above, it is necessary to have a head support to keep a bather's face out of the water. It is also necessary to maintain the anatomically correct relationships in the natural curves of the spine. We know that pushing the head forward flattens the cervical curve of the neck, distorts the thoracic and lumbar curves and stresses the sacrum. Cervical supports without corresponding accommodation for the head's posterior mass can intensify, rather than flatten, the four natural curves of the spine. That is just as detrimental as flattening the curves. The instant design balances the relationship between the curve of the neck and the opposing cure of the head. Without the appropriate scoop for the head, the head is thrust forward, which creates misalignments throughout the skeleton and the soft tissues of the head, neck and torso all the way down to the sacrum and coccyx. Thrusting the head forward flattens the natural curve of the neck and presses it uncomfortably against the shelf. Thus, the sculpted neck support 15 is added. The neck support 15 is designed to work in conjunction with the head bowl 12 so that the neck is supported and the posterior shape of the head is also properly supported and positioned to create the ideal alignment for maximum comfort.

By using a head support 10 and neck support 15 that maintain proper alignment of the spine, and using the buoyancy of the water, the torso can almost float freely. Freed of it normal compression, the spine lengthens and the torso widens, producing a natural state of relaxation and comfort.

Figure 4:
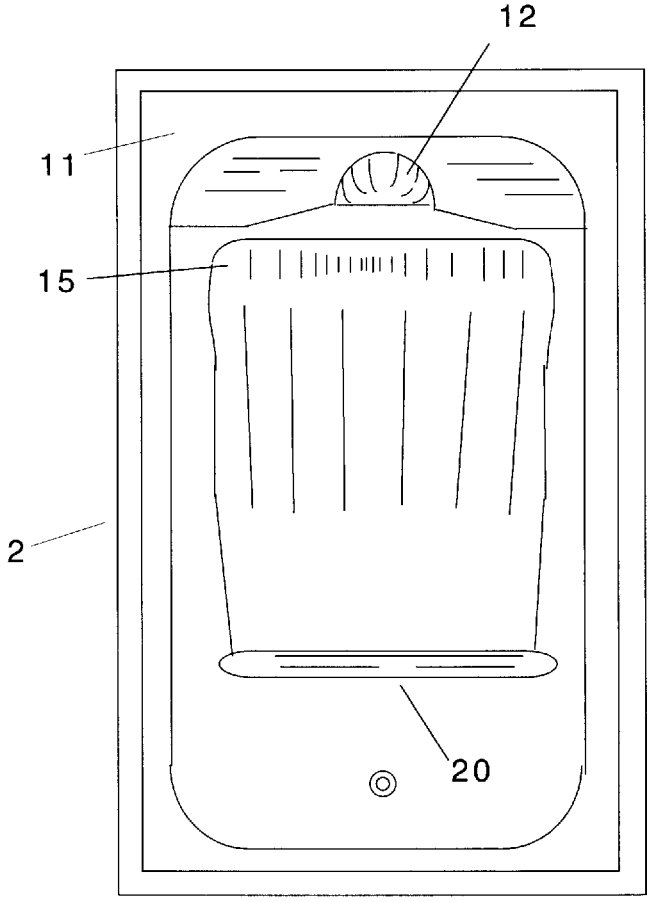
FIG. 4 is a top view of a shortened tub, designed to fit in existing tub spaces, showing an optional knee support bar.
Figure 5:
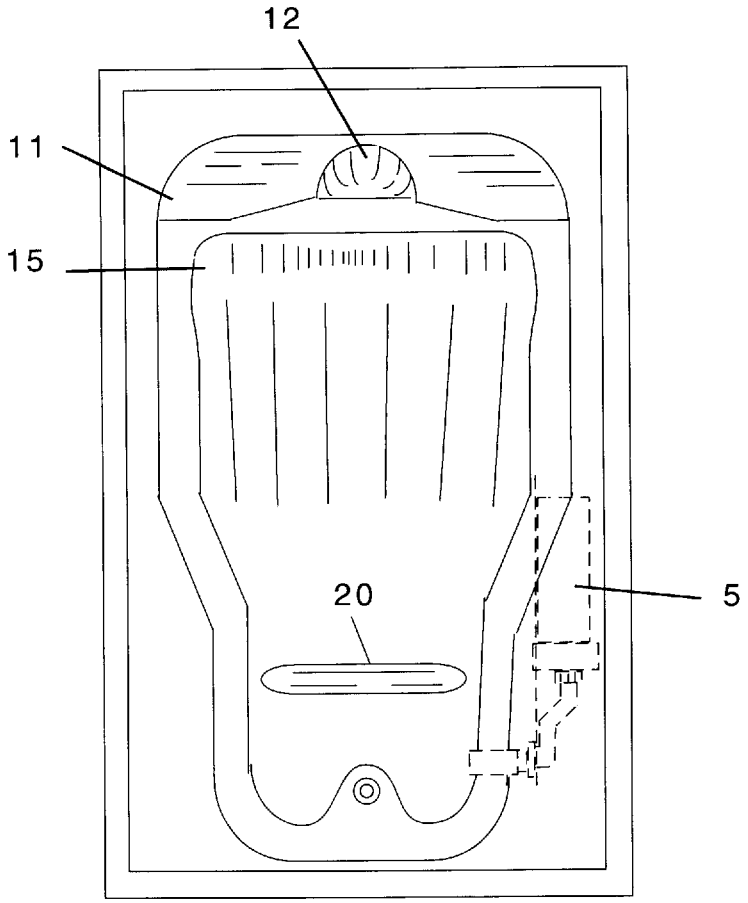
FIG. 5 is a top view of a shortened tub that includes space for jetting.
Figure 6:
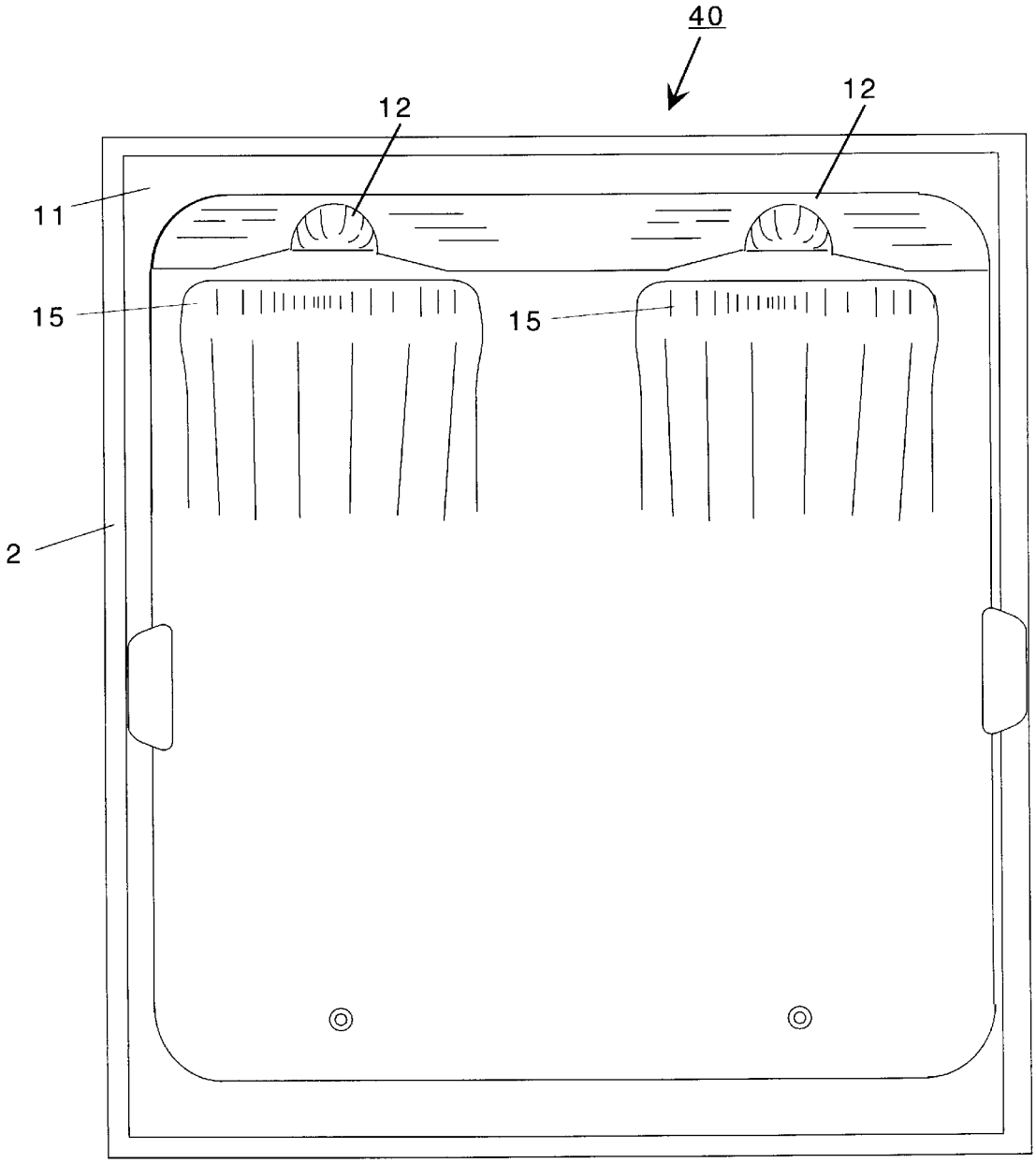
FIG. 6 is a top view of a double wide tub having side-by-side head supports.

Referring now to FIGS. 4–6, the head support 10 and neck support 15 as described above, need not be restricted to full size tubs of 84 inch length. They can be also installed in a standard length 60 inch tub. See FIG. 4. Here, an optional knee support 20 can be installed to provide additional comfort because the shorter length does not allow the bather to fully recline in the tub. FIG. 5 shows the shorter length tub with jetting 5 and the knee support 20.

Finally, custom tubs that use the head support 10 and neck support 15 combination in other configurations can be manufactured. FIG. 6 shows a double wide tub 40 that has a parallel set of head and neck supports 15. Construction of the head 10 and neck supports 15 for this tub 40 uses the same techniques and basic forms as for the single tubs 1 and 30. The only material difference is the width of the tub 40. The pair of head and neck supports are shown adjacent in the drawings. However, the supports can be reversed so that one support is at the head of the tub 40 on one side and at the foot of the tub 40 on the other.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A bathtub comprising:

a) an open tub portion, having a head end, a foot end, a floor, and opposing side walls;

b) a head support member, fixedly attached to said head end and extending into said open tub portion; and c) a neck support member, being fixedly attached to the floor of said open tub portion being spaced apart from said head support member, wherein said head support member and said neck support member are spaced apart from each other by a channel extending therebetween, said channel defining a water drainage trough which underlies and extends transversely relative to a lower portion of the user's head in use, said trough extending to at least one of said opposing side walls, wherein said neck support member and said head support member are in longitudinal alignment within said open tub portion.

2. The bathtub of claim 1 wherein said head support member comprises a shelf, fixedly attached to said head end of said open tub portion; wherein said shelf has a semi-spherical bowl portion formed therein for receiving the head of the user.

3. The bathtub of claim 1, wherein the neck support member comprises a sculpted form, having a recessed portion formed therein to receive the neck of the user.

4. The bathtub of claim 3, wherein said sculpted form has a sloped front end.

5. The bathtub of claim 1, further comprising a water jetting system fixedly attached to said bathtub.

6. The bathtub of claim 1, wherein the bathtub has an overall length of eighty-four inches.

7. The bathtub of claim 1, wherein the bathtub has an overall length of sixty inches.

8. The bathtub of claim 7, further comprising a knee support, fixedly attached to the floor of said open tub portion.

9. The bathtub of claim 8, wherein the knee support is in longitudinal alignment with said head support member.

10. The bathtub of claim 1, further comprising:

a) a second head support member, fixedly attached to said open tub portion and extending into said open tub portion; and b) a second neck support member, fixedly attached to the floor of said open tub portion and being spaced apart from said second head support member, wherein said second neck support member and said second head support member are in longitudinal alignment within said open tub portion.

11. The bathtub of claim 10, wherein said head support member comprises a shelf, fixedly attached to said head end of said open tub portion; wherein said shelf has a semi-spherical bowl portion formed therein for receiving the head of the user.

12. The bathtub of claim 10, wherein said second head support member comprises a shelf, fixedly attached to said head end of said open tub portion; wherein said shelf has a semi-spherical bowl portion formed therein for receiving the head of the user.

13. The bathtub of claim 10, wherein the neck support member comprises a sculpted from having a recess portion formed therein to receive the neck of the user.

14. The bathtub of claim 10, wherein the second neck support member comprises a sculpted form having a recess portion formed therein to receive the neck of the user.

15. The bathtub of claim 14, wherein said sculpted form has a sloped front end.

16. The bathtub of claim 10, wherein the bathtub has an overall length of eighty-four inches.

17. The bathtub of claim 10, wherein the bathtub has an overall length of sixty inches.

* * * * *